US011754235B2

(12) United States Patent
Sonneman et al.

(10) Patent No.: US 11,754,235 B2
(45) Date of Patent: Sep. 12, 2023

(54) LIGHTING SYSTEM AND STRUCTURES AND APPARATUS RELATED THERETO

(71) Applicant: Contemporary Visions, LLC, Larchmont, NY (US)

(72) Inventors: Robert A. Sonneman, Mamaroneck, NY (US); Christian N. Garnett, Mount Kisco, NY (US); Yangyang Wang, Scarsdale, NY (US); Nuno Pires Da Silva, Lisbon (PT)

(73) Assignee: CONTEMPORARY VISIONS, LLC, Larchmont, NY (US)

( * ) Notice: Subject to any disclaimer, the term of this patent is extended or adjusted under 35 U.S.C. 154(b) by 0 days.

(21) Appl. No.: 17/703,805

(22) Filed: Mar. 24, 2022

(65) Prior Publication Data

US 2022/0349535 A1 Nov. 3, 2022

Related U.S. Application Data

(60) Provisional application No. 63/200,717, filed on Mar. 24, 2021.

(51) Int. Cl.
*F21S 8/02* (2006.01)
*F21V 21/04* (2006.01)

(52) U.S. Cl.
CPC ..... *F21S 8/026* (2013.01); *F21V 21/04* (2013.01)

(58) Field of Classification Search
CPC ..... F21S 8/026; F21V 21/04
See application file for complete search history.

(56) References Cited

U.S. PATENT DOCUMENTS

| | | | | |
|---|---|---|---|---|
| 11,473,764 | B1 * | 10/2022 | Luk | F21V 23/002 |
| 2007/0217207 | A1 * | 9/2007 | Caluori | F21V 23/026 362/365 |
| 2009/0091941 | A1 * | 4/2009 | Svensson | H04R 1/026 362/404 |
| 2015/0292719 | A1 * | 10/2015 | Park | F21V 23/06 362/217.05 |
| 2019/0230424 | A1 * | 7/2019 | Christie | H04R 9/025 |
| 2021/0088066 | A1 * | 3/2021 | Clark | F16B 13/04 |

* cited by examiner

*Primary Examiner* — Christopher E Dunay
(74) *Attorney, Agent, or Firm* — Gottlieb, Rackman & Reisman, PC

(57) ABSTRACT

Light systems, systems and apparatus related thereto that aids in the installation and removal of a luminaire as well as eliminates gaps formed in a housing for the light system. The light system includes a spring-loaded attachment system for a light system, a mounting system in which a luminaire can be arranged therein that includes interchangeable plates to accommodate various size and shape luminaires, and a light-blocking rotatable housing assembly for a recessed luminaire.

10 Claims, 20 Drawing Sheets

LIGHTING SYSTEM AND STRUCTURES AND APPARATUS RELATED THERETO

CROSS-REFERENCE TO RELATED APPLICATION

This patent application claims benefit to U.S. Provisional Patent Application No. 63/200,717, filed Mar. 24, 2021, which is hereby incorporated by reference in its entirety as part of the present disclosure.

FIELD OF THE INVENTION

This present disclosure relates generally to a luminaire and structures and apparatuses related thereto, and more specifically to a spring-loaded attachment system for a light system, a light-blocking rotatable housing assembly for a recessed luminaire and a mounting system in which a luminaire can be arranged therein that includes interchangeable plates to accommodate various size and shape luminaires.

BACKGROUND OF THE INVENTION

Various luminaires and related apparatuses, structures and systems exist. One such light system is a downlight with a luminaire and related components configured to be recessed within a surface, such as a ceiling, to provide illumination in a downward direction.

A downlight assembly is commonly secured to a ceiling in a way that makes removal thereof, for example, for repair, replacement and/or adjustment, difficult, and, in some instances, impossible without replacement of the entire assembly. Additionally, removal of a recessed light system can cause significant damage to the light system and supporting and surrounding ceiling structure.

Moreover, existing housings for lighting systems are configured for installation of a particular type, size and shape luminaire. This can pose a problem when a different type, size and/or luminaire is desired to be installed. In order to replace the existing installation, the entire housing must be removed and replaced. This requires removal of a portion of a finished ceiling, removal of the housing and associated luminaire, installation of a new housing, new electrical wiring, a new luminaire and finishing work to the ceiling. As can be appreciated, the cost of both parts and labor as well as the time required to complete such a task and the waste of material is undesirable.

Furthermore, while existing recessed light systems may permit angular rotation, such systems commonly have gaps within the housing and/or between the light system and housing which allows light and, in some instances, heat to travel upwardly into the ceiling as well as create an aesthetically unpleasing appearance when an individual may look upwardly at the light fixture and view gaps in the luminaire housing.

SUMMARY OF THE INVENTION

In general, the present disclosure is directed to a light system that aids in the installation and removal of a luminaire as well as ensures no gaps are formed in a housing for the light system that could both be unsightly and cause loss of light beams being directed toward a desired direction.

In an embodiment, the present invention is directed to a light system assembly that aids in the removal of the light system from a surface, such as a ceiling. The light system comprises a housing, a lens, a light trim, and at least one fastener. In addition to the lens another accessory, such as an optical accessory can be arranged between the housing and rim. The fastener extends through an opening in the light engine, is secured to the light engine by at least one mating fastener and extends into an opening in the light trim, securing the housing to the light trim and the lens between the housing and trim. The fastener includes a shaft that is surrounded by a spring such that, when desired, an individual can apply a force to the lens upwardly, which in turn causes the spring to compress and the housing to move in an upward direction, away from the trim, allowing the individual to grasp a lip of the trim and pull the light system in a downward direction and out of the opening it is secured therein in the surface (e.g., ceiling).

In another embodiment, the present invention is directed to a housing assembly for a light system, that is configured to allow both ease of access to electrical components within a ceiling structure as well as interchangeability of plates that have an opening(s) therein to accommodate a light system and seal the housing. That is, a respective plate for the housing can be selected and fixed to the housing depending on a desired size and shaped light system without the need to use specific housings that correlate to specific size and/or shaped light systems.

In yet another embodiment, the present invention is directed to a housing assembly for a light system, that is configured to direct light both in a vertically downward direction and an angled direction while preventing gaps to form between the light assembly and the housing when the light assembly is tilted. The housing includes a base and a casing that is rotatably fixed to the base with the base and the casing configured to accommodate a light system and a sleeve configured to extend over the light system and slidably move along the exterior of the light system as the housing is tilted to aid in blocking sightlines into the housing or cavity. By ensuring no gaps exists when the light system is articulated within the housing, the housing prevents lose of directional light and prevents an aesthetically unpleasing appearance.

BRIEF DESCRIPTION OF THE DRAWINGS

The above and other features of the present invention will become more apparent by describing in detail exemplary embodiments thereof in conjunction with the accompanying drawings, in which.

DETAILED DESCRIPTION OF THE EMBODIMENTS

Figure 1:
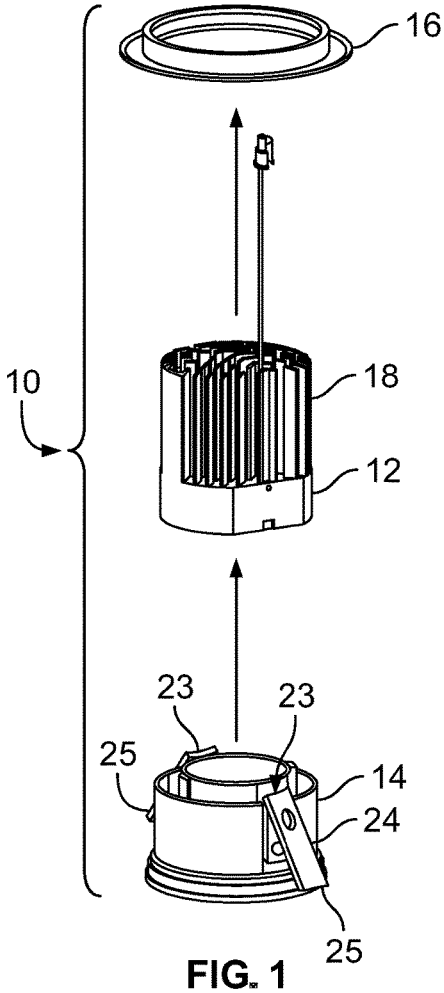
FIG. 1 is an exploded view of a luminaire assembly according to an exemplary embodiment of the present invention.
Figure 2:
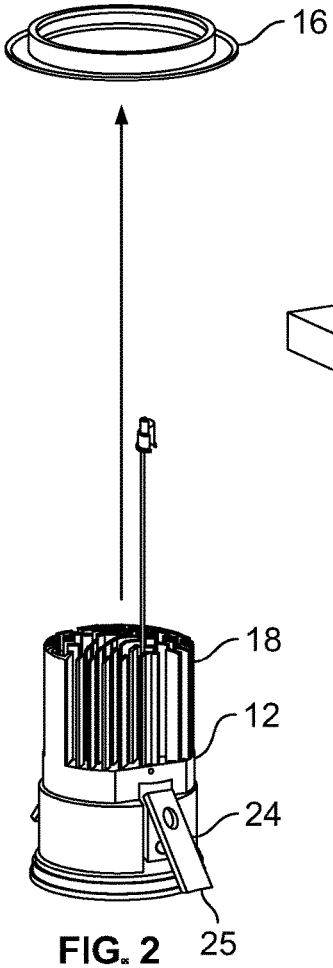
FIG. 2 is a perspective view of the luminaire assembly of FIG. 1 in a partially assembled state.
Figure 3:
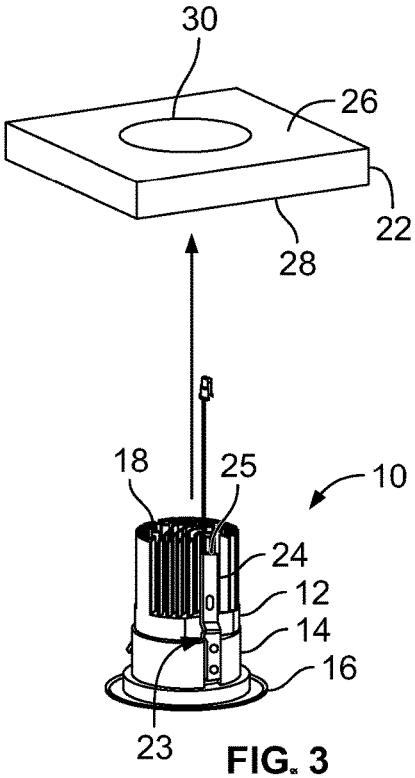
FIG. 3 is a perspective view of the luminaire assembly of FIG. 1 in a fully assembled state.

Exemplary embodiments of the present invention will now be described more fully hereinafter with reference to the accompanying drawings. The present invention may, however, be embodied in different forms and should not be construed as being limited to the embodiments set forth herein. Like reference numerals may refer to like elements throughout the specification. The sizes and/or proportions of the elements illustrated in the drawings may be exaggerated for clarity.

When an element is referred to as being disposed on another element, intervening elements may be disposed therebetween. In addition, elements, components, parts, etc., not described in detail with respect to a certain figure or embodiment may be assumed to be similar to or the same as corresponding elements, components, parts, etc., described in other parts of the specification.

Figure 9:
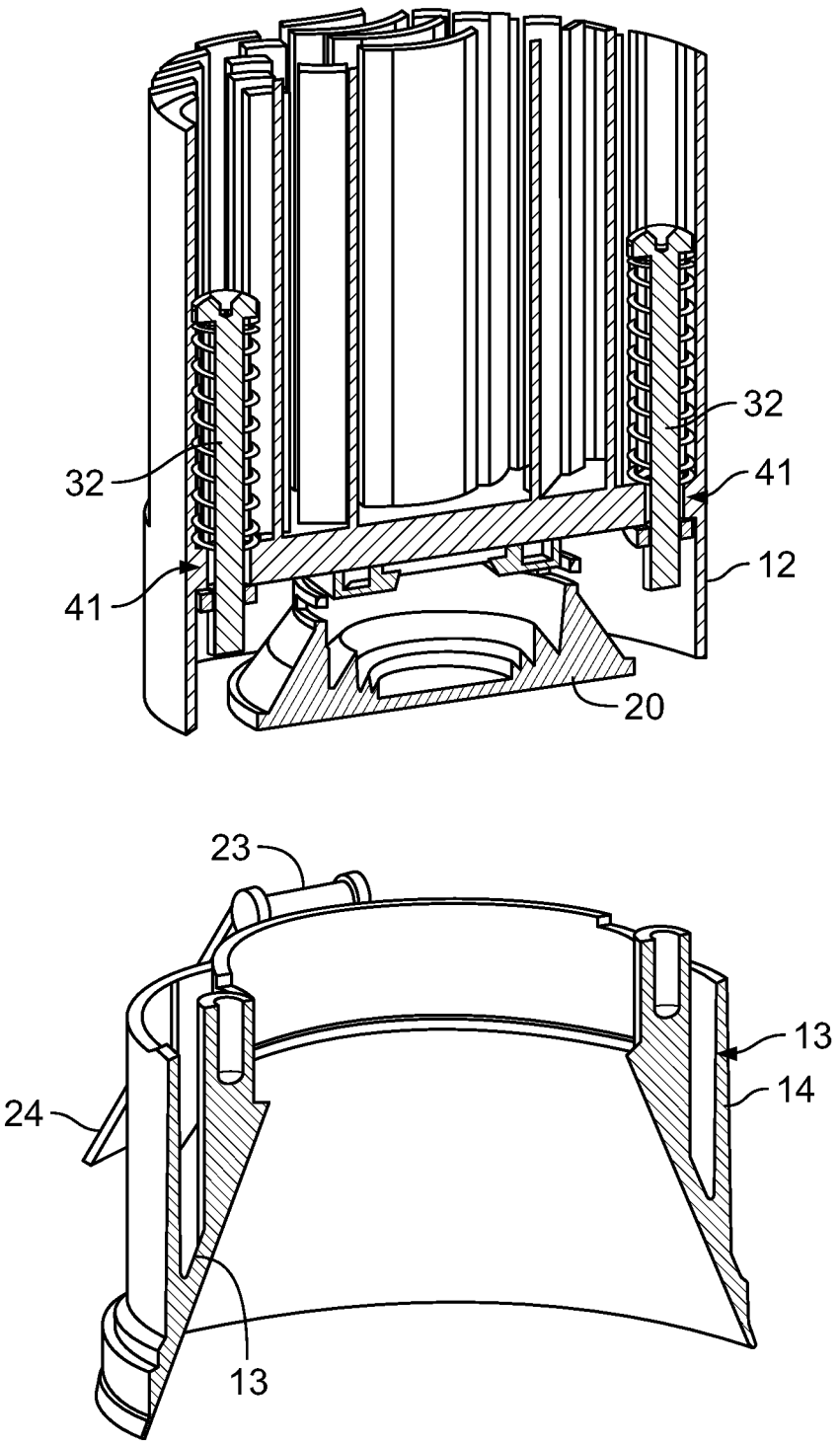
FIG. 9 is a partially exploded view of a housing and trim of the luminaire of FIG. 1.
Figure 10:
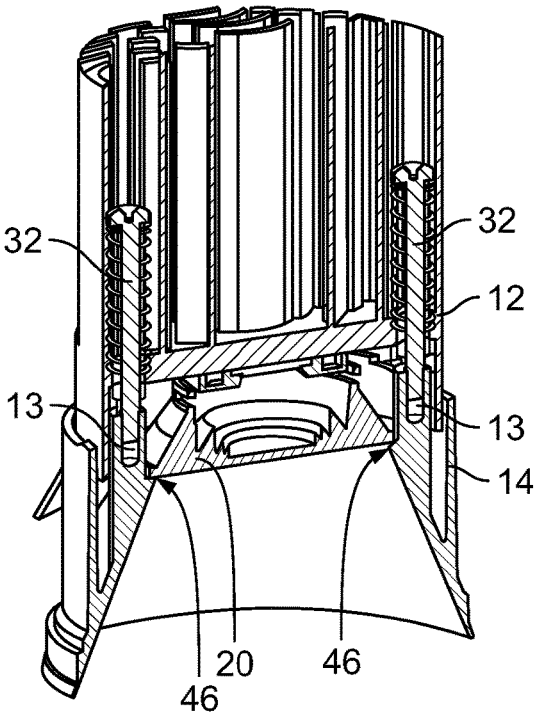
FIG. 10 is a perspective cross-sectional view of the housing, lens, spring-loaded fastening assembly and light trim of the luminaire of FIG. 1 in an assembled state with the spring-loaded attachment mechanism in a compressed state to keep the lens secure between the housing and the light trim.
Figure 11:
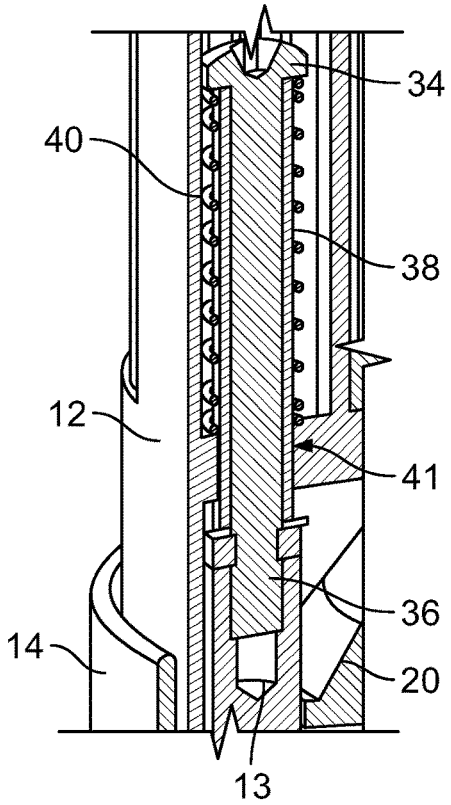
FIG. 11 is a detail view of FIG. 9 of the spring-loaded fastening assembly.

FIGS. 1-16 illustrate a luminaire assembly 10 according to an exemplary embodiment of the present disclosure. As can be seen in FIGS. 1-4, the luminaire assembly 10 in various states of assembly broadly includes a housing 12, a trim 14 and a flange ring 16. The housing 12 includes a heat sink 18 that extends from the housing and a light engine and a light source that are arranged within the housing 12. A lens 20 is arranged between the housing 12 and the trim 14 (See FIG. 9).

Figure 4:
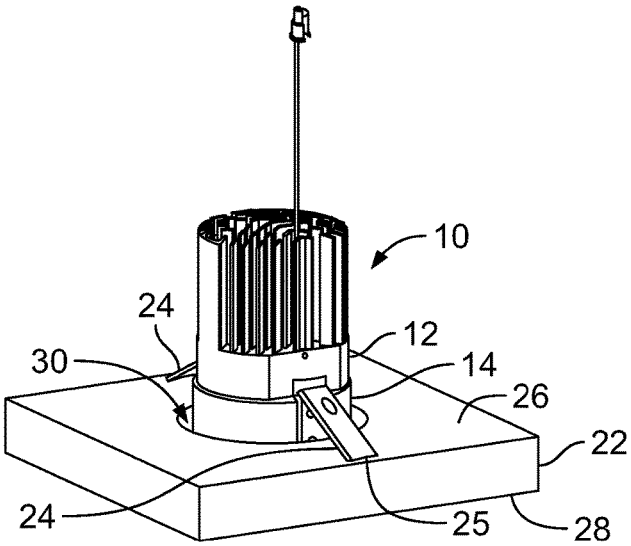
FIG. 4 is a perspective view of the luminaire of FIG. 1 mounted within a surface.
Figure 5:
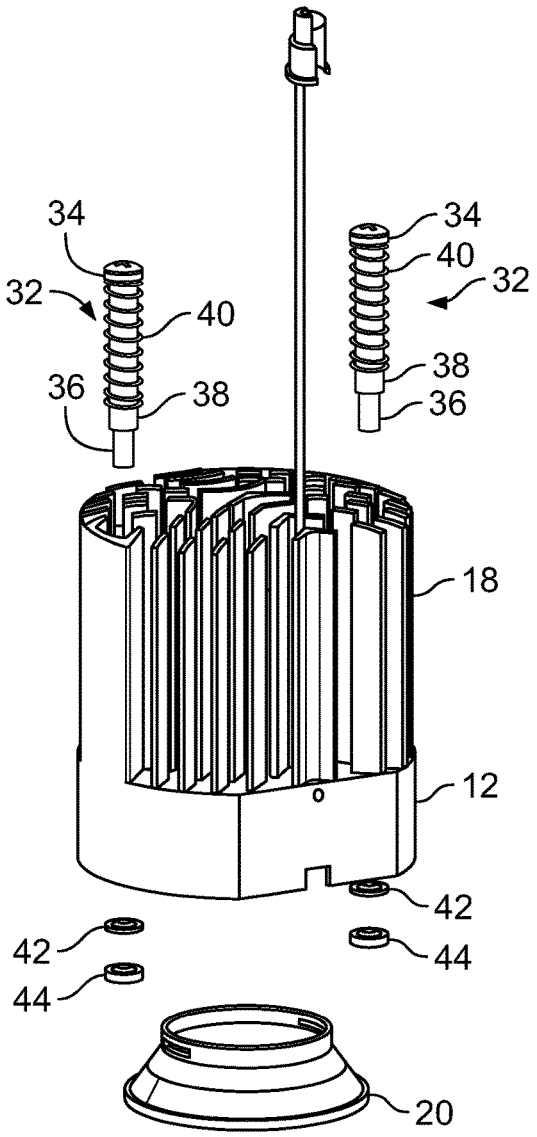
FIG. 5 is an exploded view of a housing and associated attachment of the luminaire of FIG. 1.
Figure 6:
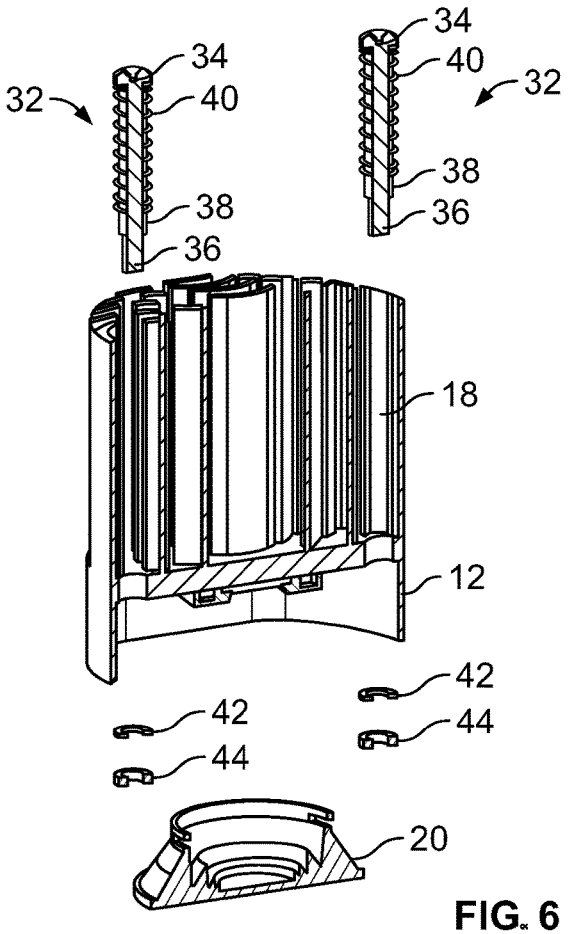
FIG. 6 is a cross-sectional view of FIG. 5.

FIG. 4 depicts the luminaire assembly that is secured within a surface structure 22, such as a ceiling, by spring arms 24 that are fixed to the light trim 14. The arms 24 are configured to move between a first, resting position where a distal end 25 of each arm 24 extends away from the light engine 12.

To install the luminaire assembly 10 within the surface structure 22, the arms are rotated towards the housing 12 and once the luminaire assembly 10 extends within the surface structure 22, the spring arms 24 return to a natural resting state, bearing against an interior surface 26 of the surface structure 22 with the flange ring 16 bearing against an exterior surface 28 of the surface structure 22 to secure the luminaire assembly 10 within an opening 30 of the surface structure 22.

FIGS. 5-16 depict an embodiment of an assembly of the housing 12 fixed to the light trim 14 by fastening assemblies 32. The fastening assemblies 32 include a head 34 and a shaft 36 (e.g., a screw), which is encompassed by a spacer sleeve 38 and a spring 40 that extends over the sleeve 38. The spring 40 is a compression spring.

Figure 7:
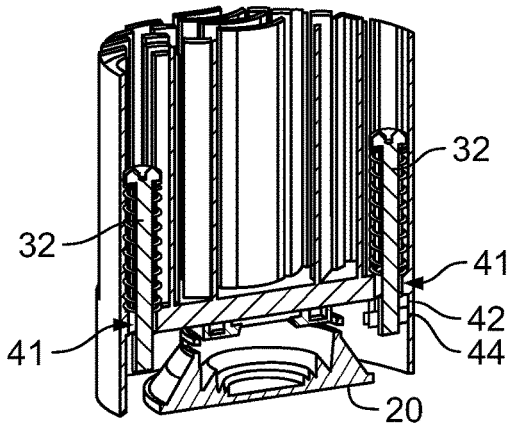
FIG. 7 is a cross-sectional view showing the spring-loaded attachment in a partially assembled state.
Figure 8:
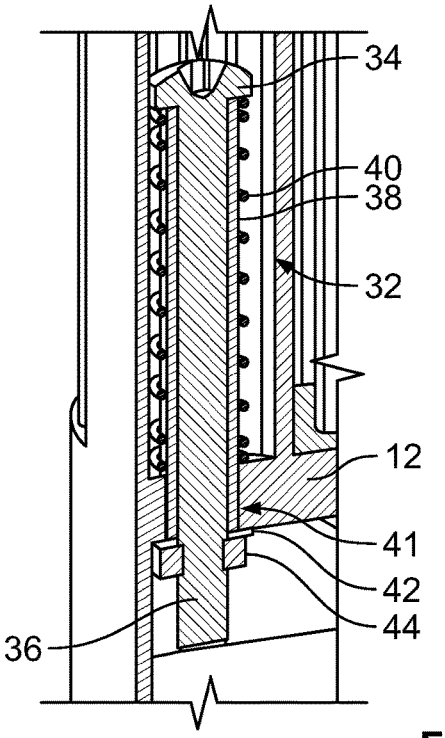
FIG. 8 is a detail view of the spring-loaded attachment of FIG. 7.

The spring-loaded fastening assemblies 32 are configured to extend though openings 41 in the housing 12 and be fixed to the housing 12 by one or more mating fasteners 42, 44, such as a washer and nut. The lens 20 is fixable to the housing 12 as shown in FIG. 7.

Once the spring-loaded fastening assemblies 32 are fixed to the housing 12, the housing 12 and trim 14 are orientated such that the spring-loaded fastening assemblies 32 are aligned with holes 13 of the trim 14 and extend therein (see FIGS. 9-13), fixing the housing 12 and the trim 14 to each other. The holes 13, can be threaded to secure the spring-loaded fastening assemblies 32 to the trim 14. When the spring-loaded fastening assemblies 32 are tightened, an outer periphery of a distal side of the lens 20 contacts a lip 46 of the trim 14 to secure the lens 20 between the housing 12 and the trim 14. Ensuring the lens 20 is secure between the housing 12 and the trim 14, allows for a higher optical efficiency and a blockage of airflow through the opening 30 in the surface 22. By blocking the airflow, a reduction of hot air upward through the ceiling 22 via the opening is precluded.

Figure 12:
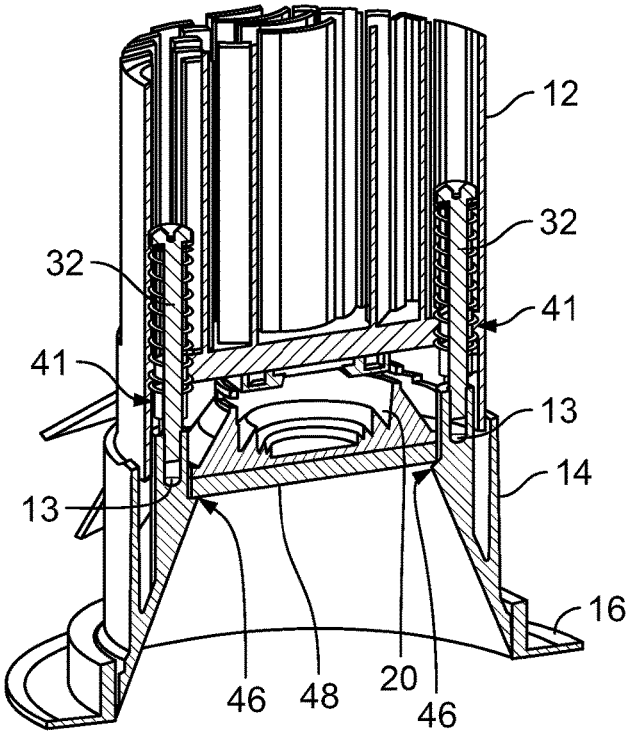
FIG. 12 is a perspective cross-sectional view of the housing, lens, spring-loaded fastening assembly and light trim of the luminaire of FIG. 1 in an assembled state with an accessory located beneath the lens and with the spring-loaded attachment mechanism in a compressed state to keep the lens secure between the housing and the light trim.
Figure 13:
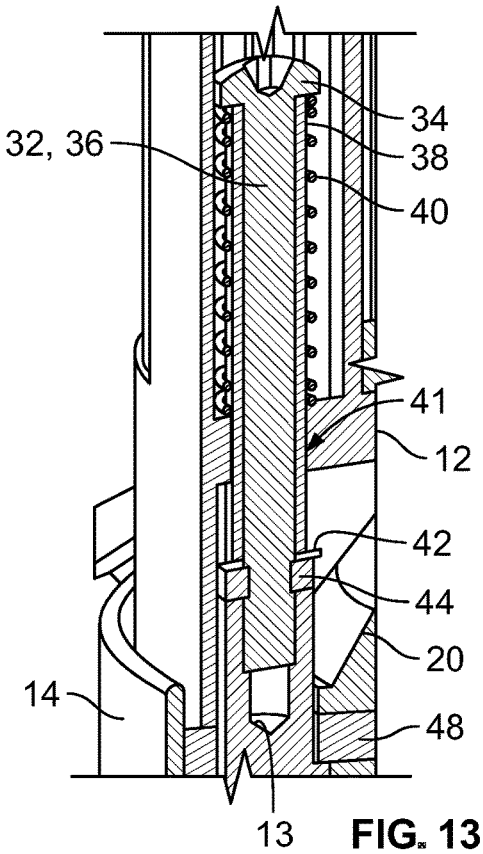
FIG. 13 is a detail view of FIG. 11 of the spring-loaded attachment mechanism.

FIGS. 12 and 13 depict an accessory or light filter component 48 that can be arranged between the lens 20 and the lip 46. The accessory 48 can be added to the luminaire assembly 10 without the need to disassemble the light engine 12 from the trim 14 while ensuring a secure connection between the light engine 12 and the trim 14 is maintained. More than one accessory 48 can be included in the assembly, if desired.

Figure 14:
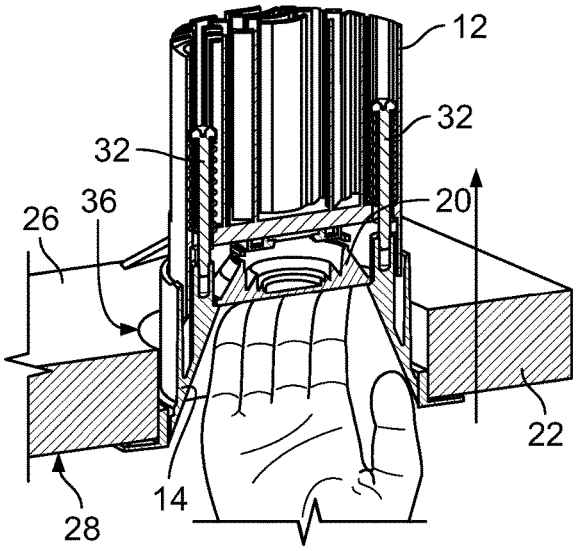
FIGS. 14-16 are cross-sectional views that illustrate sequentially the removal of the luminaire of FIG. 1 from an installed state.
Figure 15:
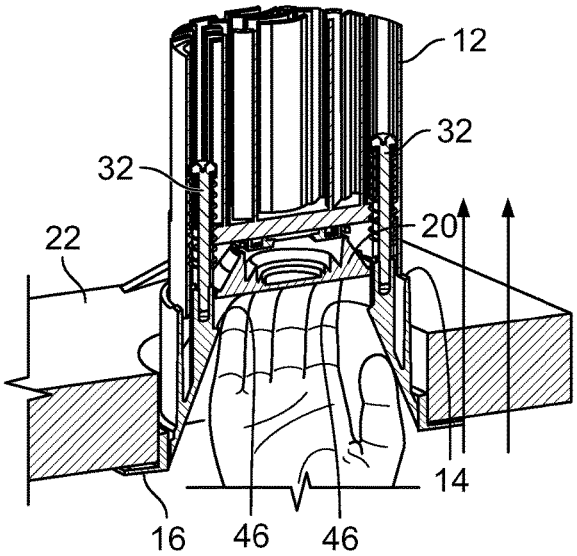
Figure 16:
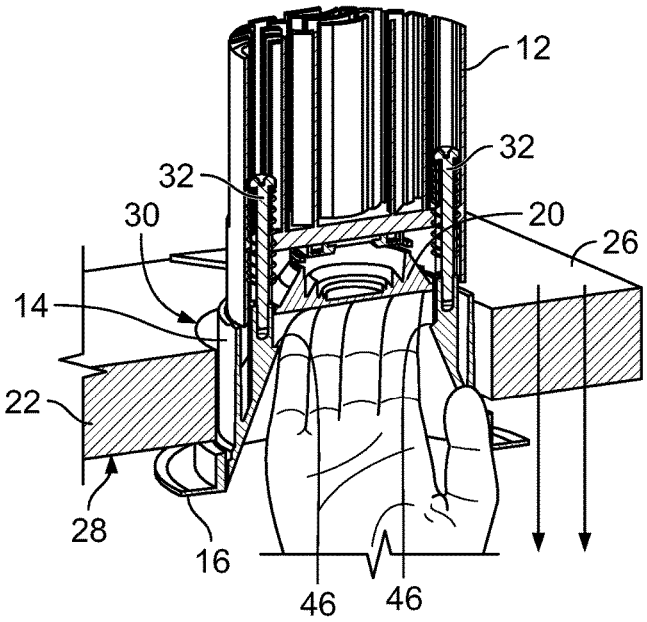

FIGS. 14-16 illustrate various stages of the removal of the luminaire assembly 10. First, a user can push upwards against the lens 20 or lens 20 and accessory 48 (when included). This in turn compresses the springs 40 that surrounds the fastening assemblies 32. By compressing the springs 40, the housing 12 forced to move away from the trim 14 and a gap is created between the lens 20 or lens 20 and accessory 48 and the lip 46 of the trim 14. The user can then grip the lip 46 as shown in FIG. 14 and then, as seen in FIG. 15, pull the luminaire assembly 10 downward from the surface 22. As the luminaire assembly 10 is moved further out of the opening 30, the arms 24 bend upward due to a biasing force on the spring 23 of the arms 24 to allow the luminaire assembly 10 to be fully removed from the opening 30. Thus, the assembly 10 allows for easy access and removal thereof, when desired without damage to surrounding structures or the assembly 10.

Additionally, in certain applications, such as new construction or when remodeling, it may be desirable to utilize a housing for a luminaire assembly that is mounted to a surface structure, such as a ceiling. After the housing and applicable wiring for a luminaire that is to be arranged within the housing is installed, the surface surrounding and encompassing the housing with the exception of an opening in which the luminaire will be arranged in the housing, can then be finished by installing drywall over the surface structure and housing, mud-in skim coating, flangeless millwork, installing ceiling tiles, etc.

FIGS. 17-45 illustrate universal housing assemblies 100, 200 for luminaires that, as will be described below, can accommodate luminaires of various sizes and shapes.

The type of housing that may be utilized in such an application will depend on whether an insulation contact rated (IC) housing or a non-insulation contact rated housing is required.

FIGS. 17-26 illustrate embodiments of insulation contact rated (IC) luminaire housing assemblies 100. The housing 100 is configured to be recessed within a ceiling structure to accommodate a luminaire. The housing 100 includes a first sidewall 102, a second sidewall 104, a third sidewall 106, a four sidewall 108, fifth sidewall 110 and a sixth sidewall 112. The sidewalls 102-112 are fixed to and/or contiguous to and extend from each other to define a cavity 114. The first sidewall or base 102, includes an opening 116 therein.

Figure 17:
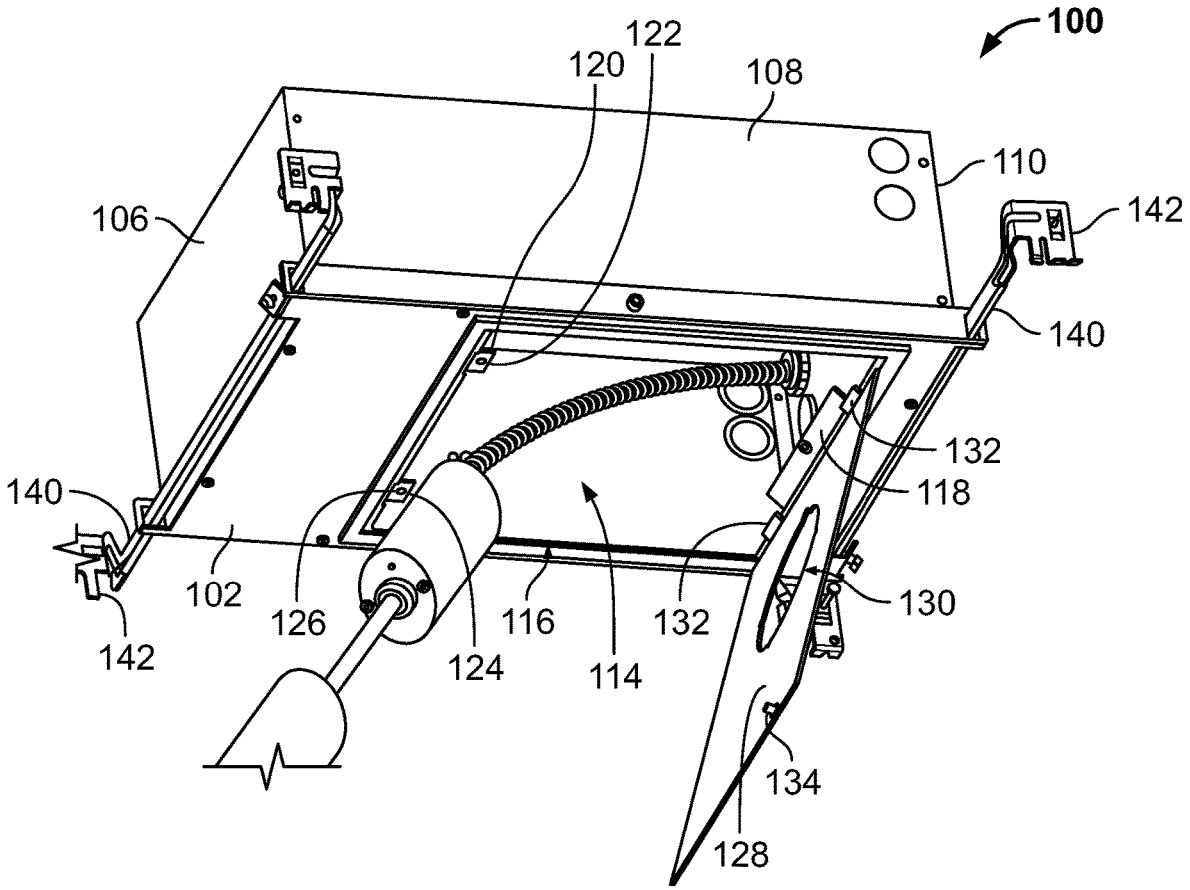
FIG. 17 is a perspective view of a housing assembly for a luminaire according to an embodiment of the present disclosure.
Figure 18:
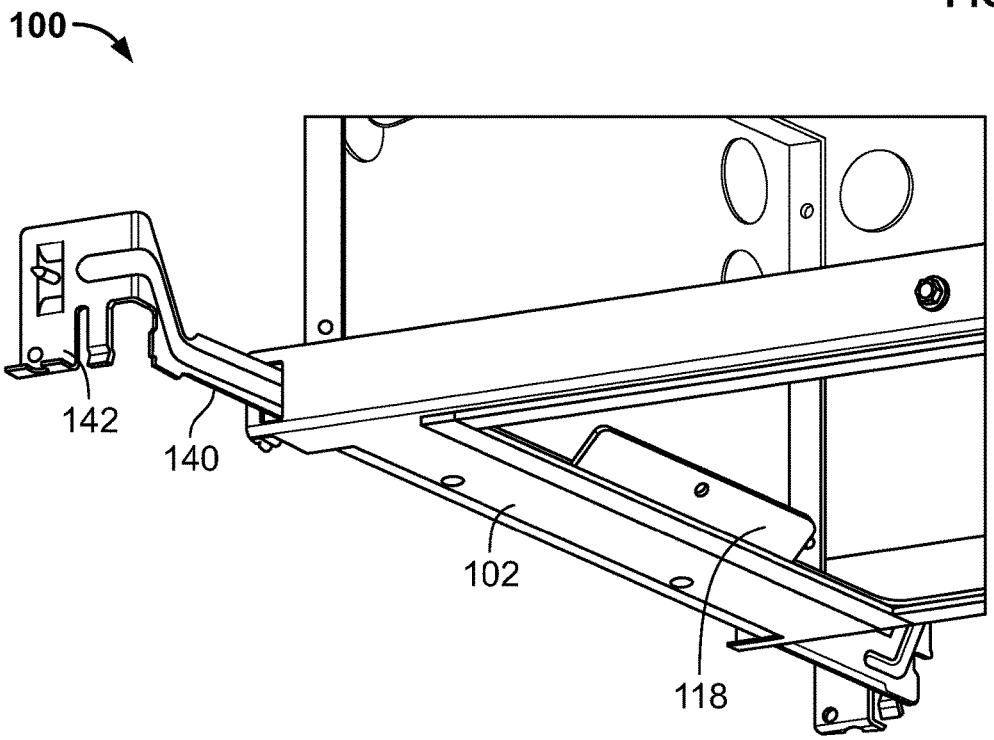
FIG. 18 is a sectional view of the housing assembly of FIG. 17.
Figure 19:
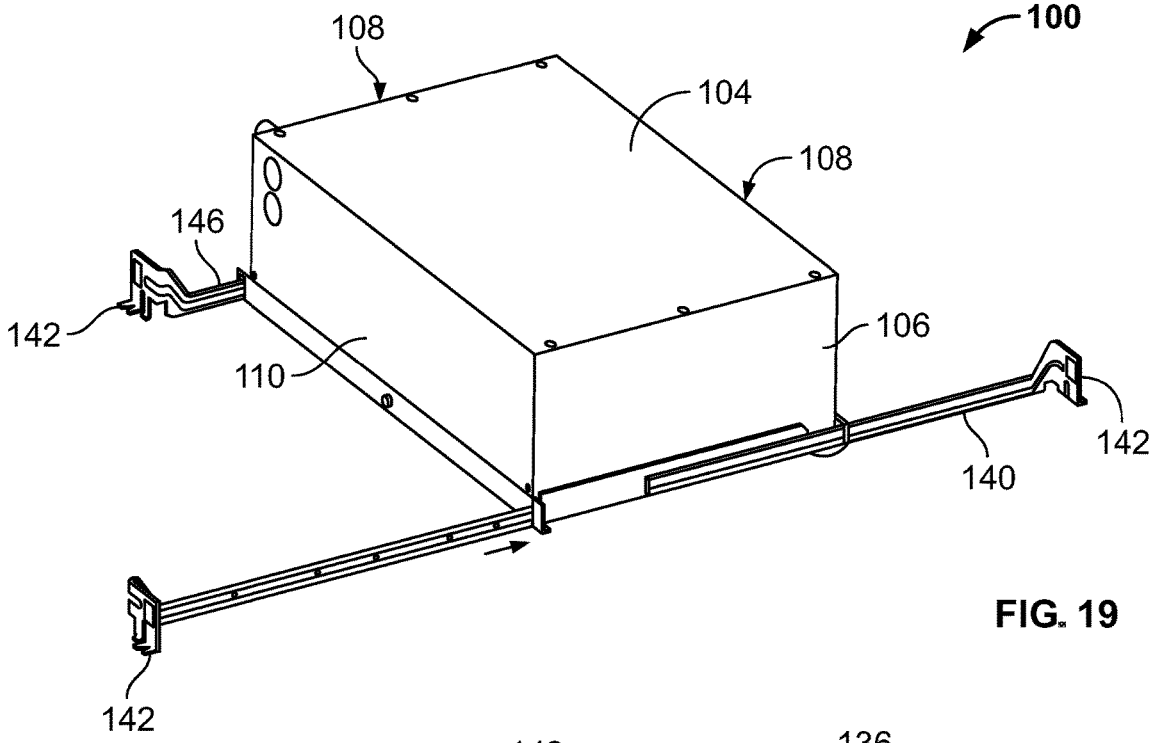
FIG. 19 is a perspective view of the housing assembly of FIG. 17.
Figure 20:
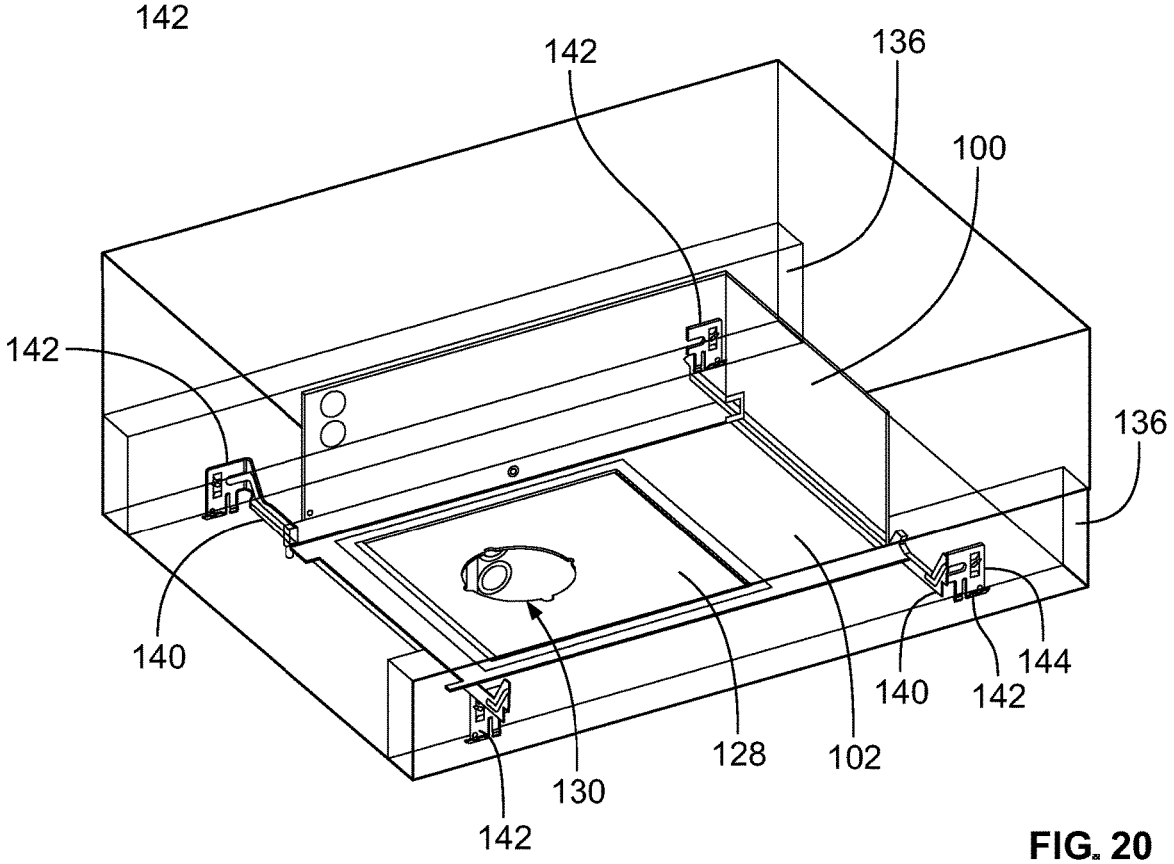
FIG. 20 is a perspective view of the housing assembly of FIG. 17 assembled to a surface.
Figure 21:
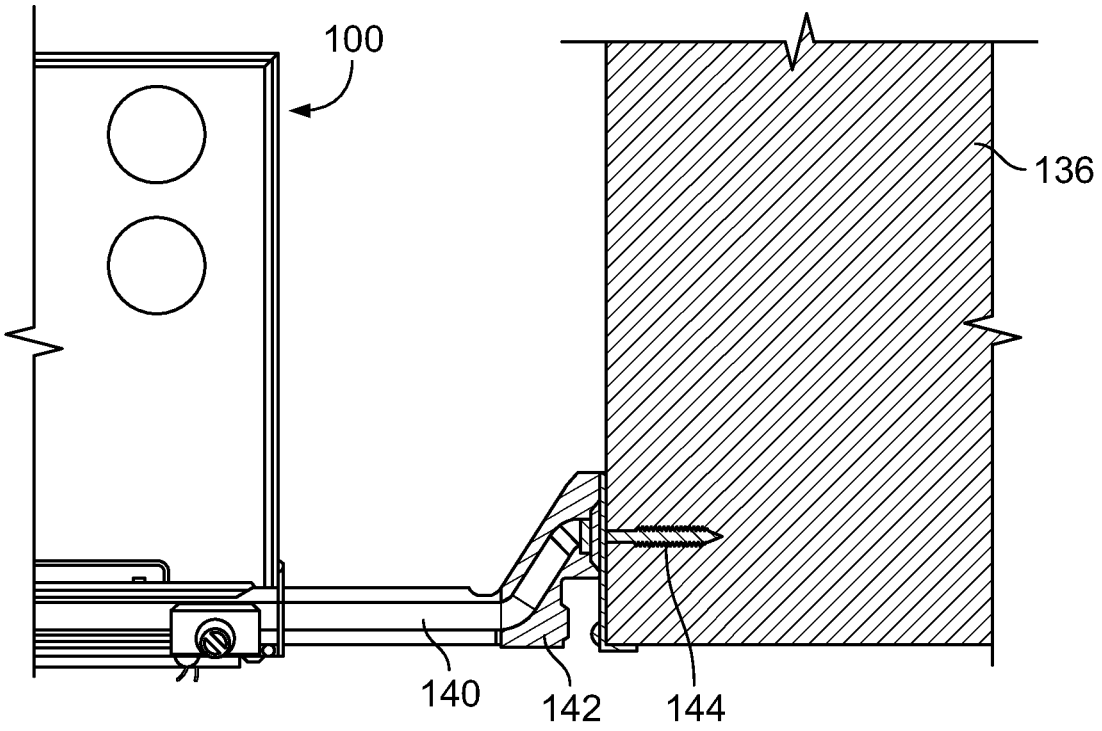
FIG. 21 is a cross-sectional view of the housing assembly of FIG. 17 assembled to the surface.
Figure 22:
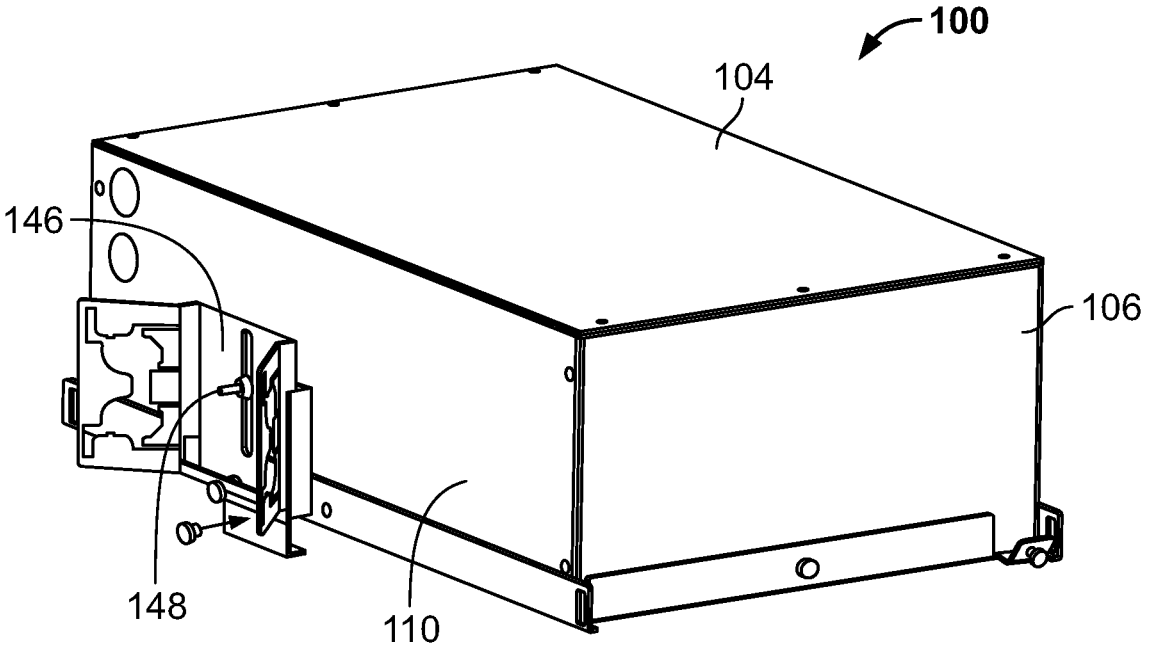
FIGS. 22-24 are view of the housing assembly of FIG. 17 with a bracket fixed to the housing to aid in assembling the housing to a surface.
Figure 23:
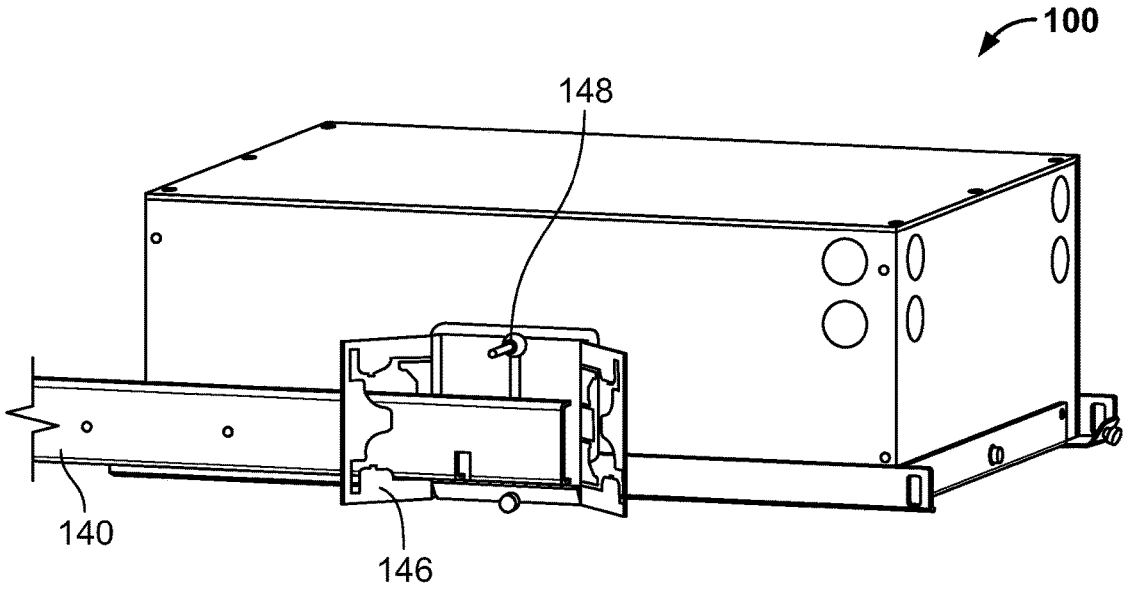
Figure 24:
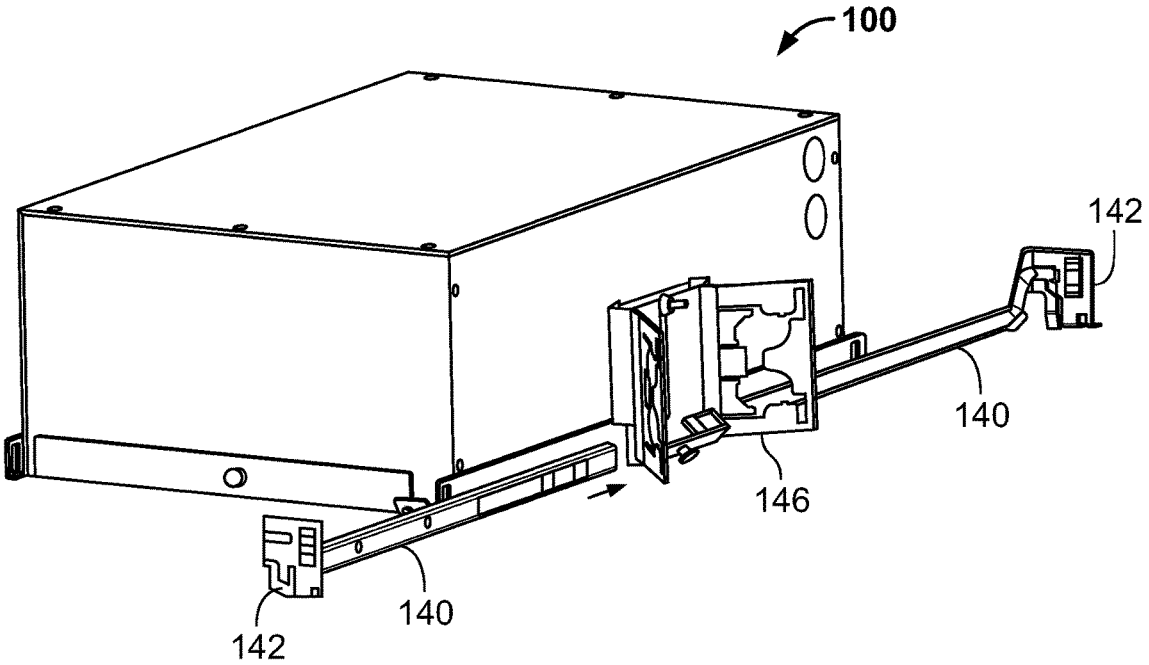
Figure 25:
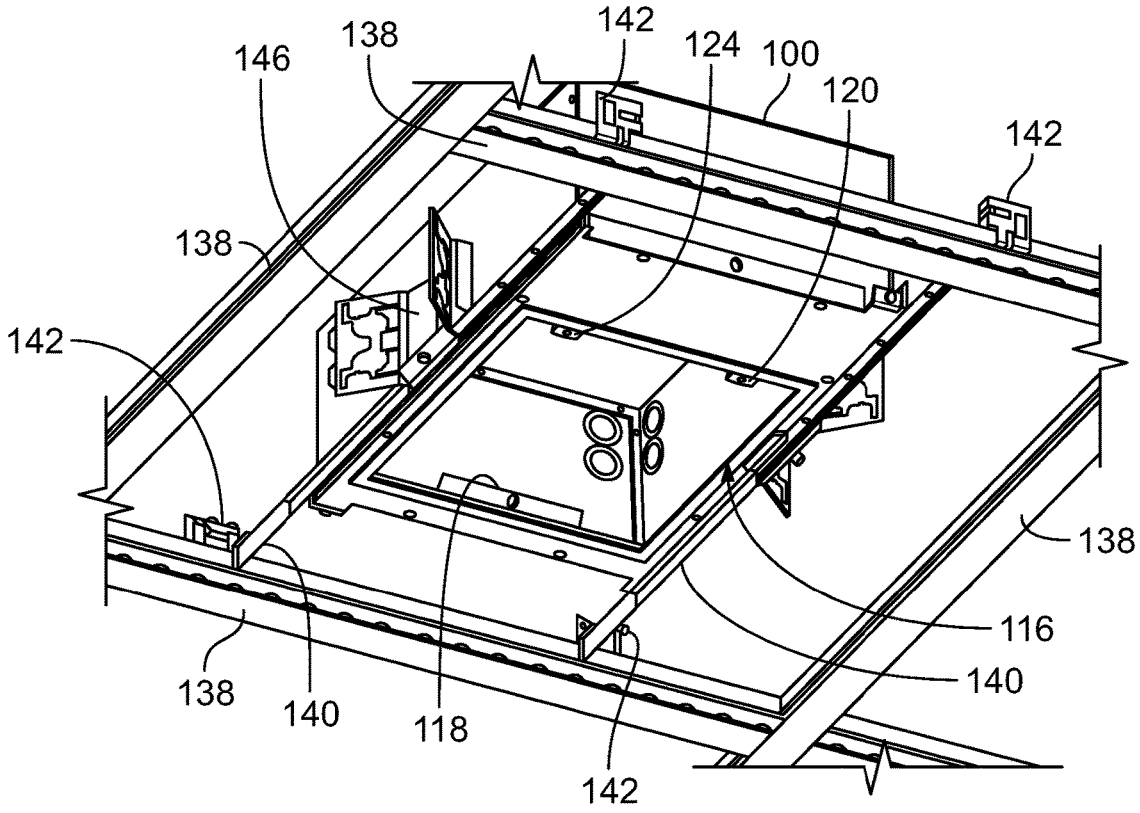
FIGS. 25-26 are assembly views of the housing assembly of FIG. 17 utilizing the bracket of FIGS. 22-24 to secure the housing assembly to a supporting surface.
Figure 26:
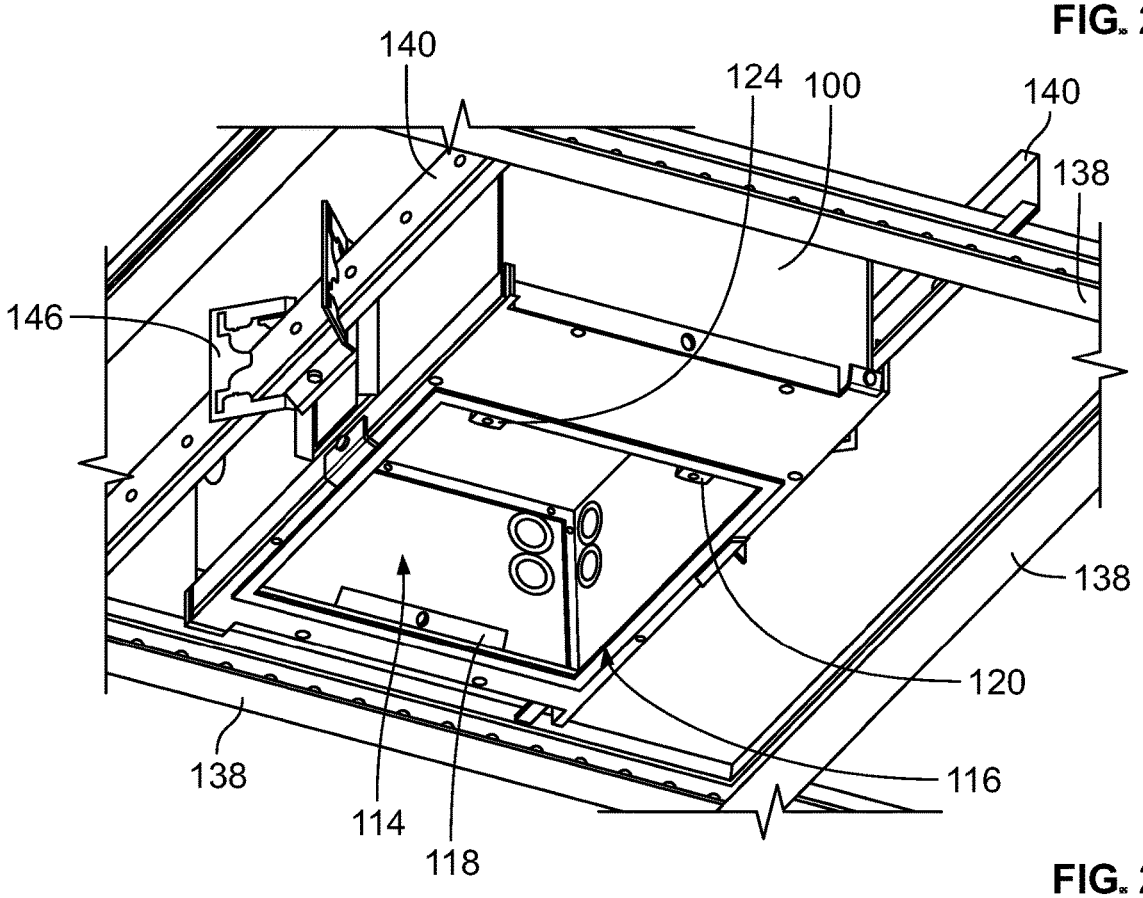

As can be seen in FIGS. 17 and 18, for example, a linear bar 118 extends from the first sidewall 102 at an angle into the opening 116. Additionally, a first tab 120 with a through hole 122 and a second tab 124 with a through hole 126 that is spaced from the first tab 120 extend from an opposite end of the opening 116 of the first sidewall 102 toward the angled linear bar 118.

A plate 128 that includes an opening 130 therein is configured to be releasably and hingedly fixed to the housing 100 to, in a closed state, seal the opening 116 of the housing 100. The plate 128 includes a hinge 132 that interacts with the bar 118 that projects from the housing 100 to hingedly fix the plate 128 to the housing 100 and at the opposite end of the plate 128, fasteners 134 (such as screws) that are configured to extend through the openings 122, 126 of the tabs 120, 124 to fix the plate 128, in a closed state, to the housing 100 and seal the opening 116 of the housing 100. The plate 128 allows for easy access to the cavity 114 within the housing 100 when the fasteners 134 are not secured to the tabs 120, 124.

The plate 126 can easily be replaced with another plate (See e.g., FIGS. 28-34) that has a different internal opening. The ability to remove and replace the plate easily with other plates to accommodate different size and shape luminaires is desirable as the same housing can be used to accommodate a variety of size and shaped luminaires without having to use a various housings designed for specific luminaires. This is further helpful when an individual wishes to replace a luminaire arranged in the housing with a luminaire of a different shape or size. While the plate must be removed and replaced, the housing does not. This both saves time and cost. As such the interchangeability of plates that have various openings offer flexibility that previously did not exist. Exemplary embodiments of plates are shown in FIGS. 28-34 and described further below.

Figure 27:
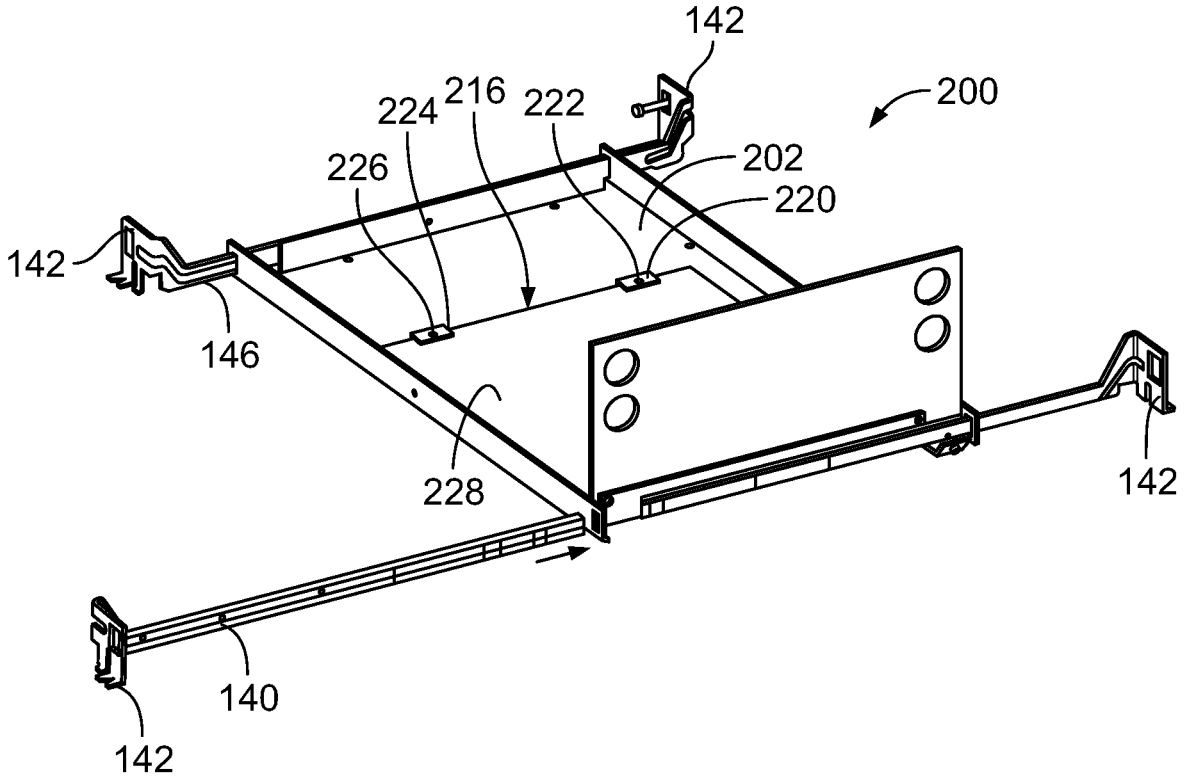
FIG. 27 is a perspective view of another housing assembly for a luminaire according to an embodiment of the present disclosure.

In an environment where a non-insulation contact rated housing is desired, as illustrated in FIG. 27, the housing or pan 200 can be open such that the luminaire is arranged within an enclosure, but rather supported by a plate 228 that is fixed to a base wall 202. Similar to the insulation contact rated luminaire assembly 100, a linear bar (not shown) extends from the pan 202 at an angle into the opening 216. Additionally, a first tab 220 with a through hole 222 and a second tab 224 with a through hole 226 that is spaced from the first tab 220 extend from an opposite end of the opening 216 of the pan 202 toward the angled linear bar. Also, like the insulation contact rated luminaire assembly 100, plates can be incorporated and interchanged depending on the size and shape of a desired luminaire to be arranged in the housing 200. The interaction of the plates with the housing and the shapes and sizes of the plates are identical to the plates that can be incorporate into the insulation contact rated luminaire assemblies. One such plate 228 is shown in FIG. 27.

To fix the housing to a surface such as a wood joint 136 or a T-grid 138 (see FIGS. 20, 21, 25, 26), a pair of bar hanger 140 are fixed to and extend from the housing 100. The configuration of the hangers 100 depends on the configuration of the surface (e.g., beams or hangers) to which the housing assembly 100 is to be mounted.

As shown in FIGS. 17-21, the hangers 140 are fixed to and extend from the third and fifth sidewalls 106, 110 whereas in FIGS. 22-26, the bar hangers 140 are fixed to and extend from the fourth and sixth sidewall 108, 110. The bar hangers 140 are delimited at each end by a flange 142 that has openings and/or slots through which a fastener 144 can extend to secure the bar hanger 140 and in turn the housing 100 to a desired surface. In an embodiment, the length of each bar hanger 140 may be telescopically adjustable can be selectively set to the distance between two neighboring mounting positions.

In another embodiment, the bar hanger 140 can be adjusted vertically between the first sidewall 102 and the second sidewall 104 by bracket 146 that can be releasably fixed to sidewalls of the housing 100. The bracket 146 can include one or more slots and/or openings to allow for adjustment of the bracket 146 and in turn bar hangers 140 vertically. Once a desired orientation is determined, the bar hanger 140 can be set in place with respect to the housing by a fastener 148 such as nut (e.g., wing nut).

FIGS. 28-34 depict plates 150, 152, 154, respectively, that are identical to each other except for the circular openings 151, 153, 155, respectively, that extend therethrough. Each plate 150, 152, 154 includes a hinge 156, 158, 160, respectively, and fasteners at an opposite end of each plate 150, 152, 154 to aid in both hingedly securing and fastening the plate 150, 152, 154, respectively, to a housing 100, 200.

Figure 28:
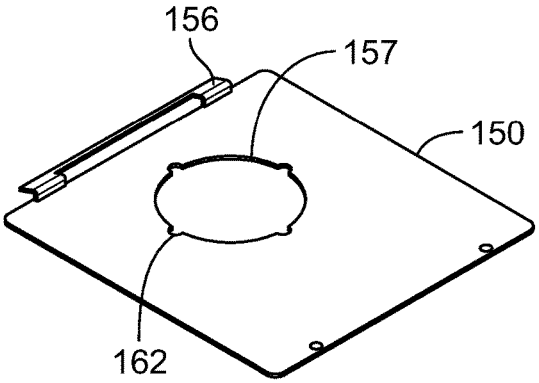
FIGS. 28-34 are perspective view of various plates that are configured to be assembled with the housing assembly of FIG. 17 and FIG. 27.
Figure 29:
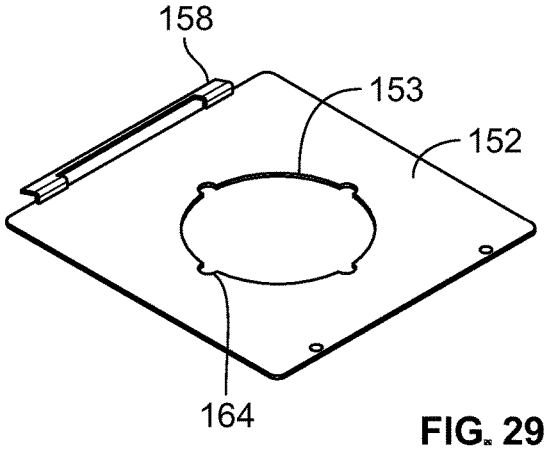
Figure 30:
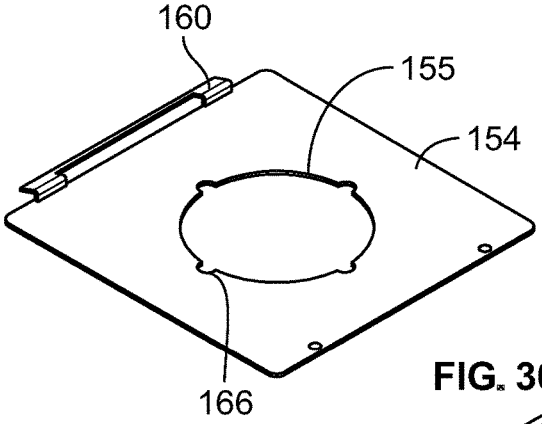

In FIG. 28, the plate 150 includes an opening 151 that has three notches 162. In FIG. 29, the plate 152 includes an opening 153 with a diameter that is greater than the plate 150 in FIG. 28 and has four notches 164. In FIG. 30, the plate 154 includes an opening 155 with a diameter that is greater than the plate in FIG. 29 and has four notches 166.

Figure 31:
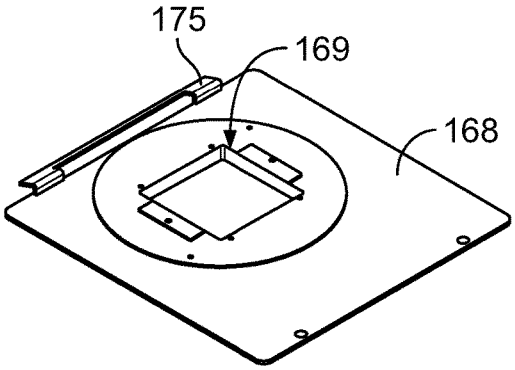
Figure 32:
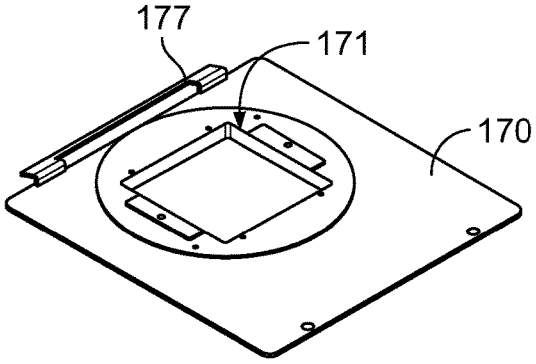
Figure 33:
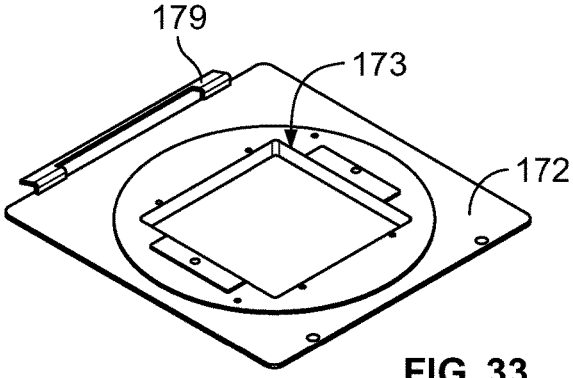
Figure 34:
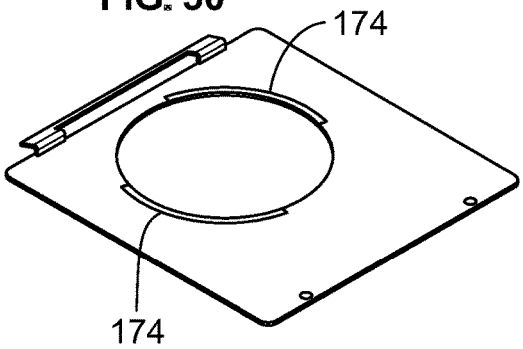

FIGS. 31-33 depict plates 168, 170, 172, respectively, that are identical to each other except for the size of the square openings 169, 171, 173, respectively, that extend therethrough and hinges 175, 177, 179, respectively. As can be seen in FIG. 34, for square trims of luminaires, the plates include curved slots 174 that allow for the square shaped opening to be attached and rotate within the opening of the plate to align the square shaped opening with other fixtures.

Figure 35:
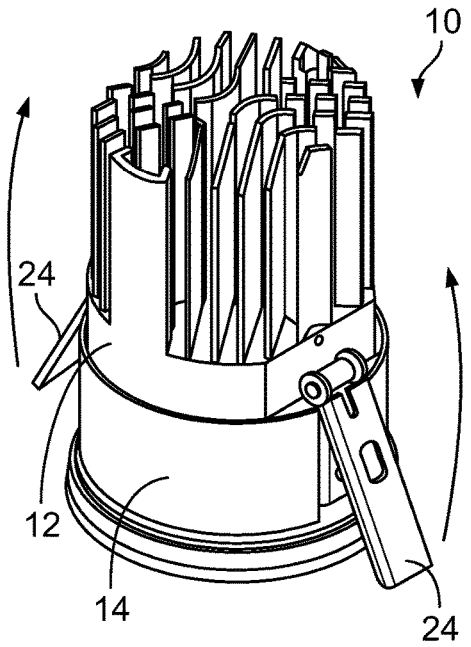
FIGS. 35-37 are various views of the luminaire of FIG. 1 being assembled within the housing of FIG. 17.
Figure 36:
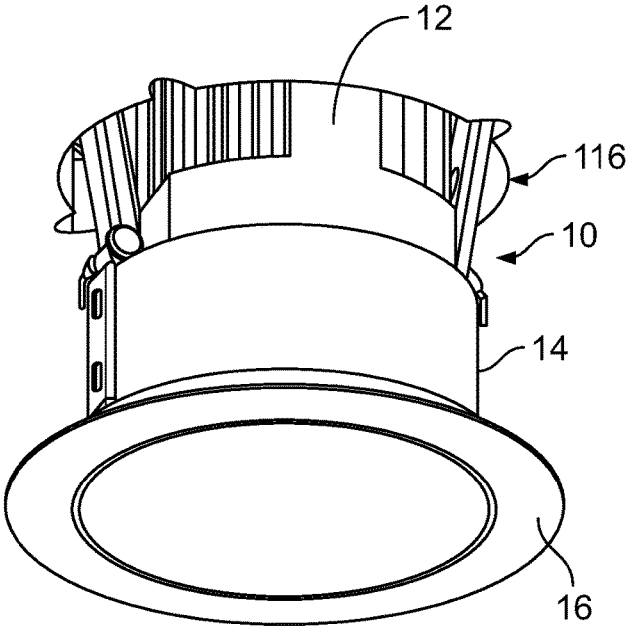
Figure 37:
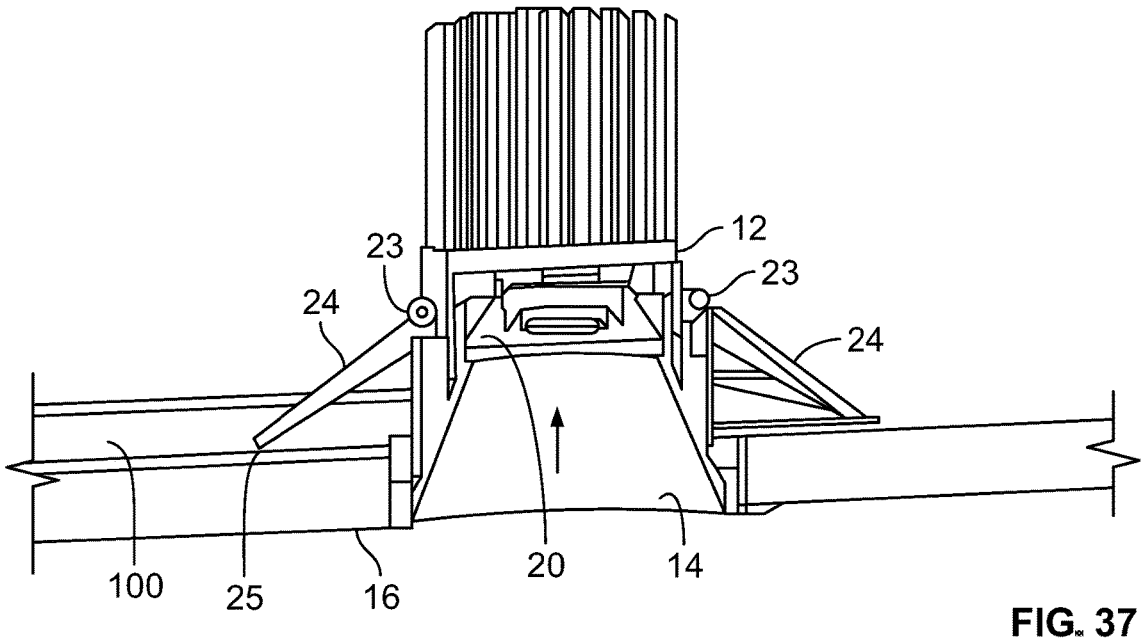
Figure 38:
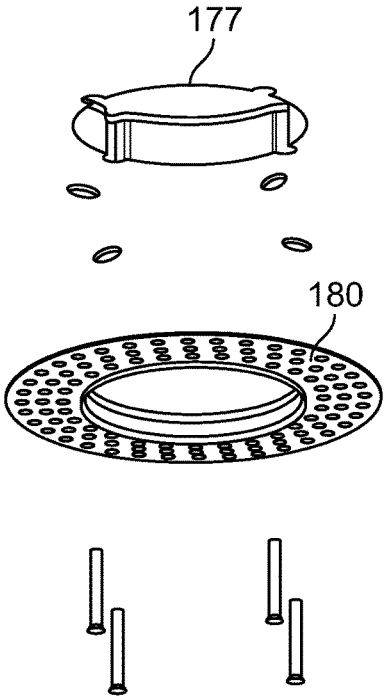
FIGS. 38-45 are various views of embodiments of rough-in flanges being assembled to the housing of FIG. 17 and skim coated thereafter.
Figure 39:
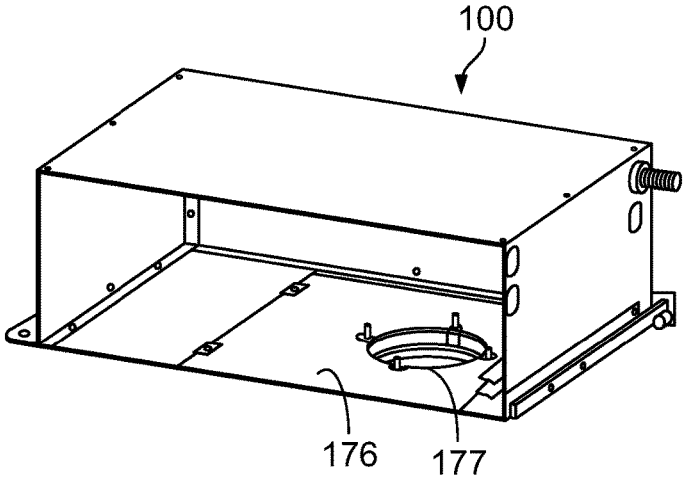
Figure 40:
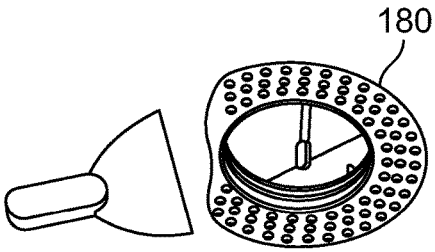
Figure 41:
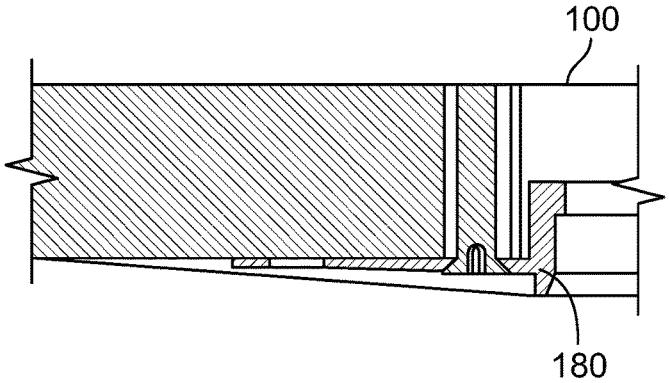
Figure 42:
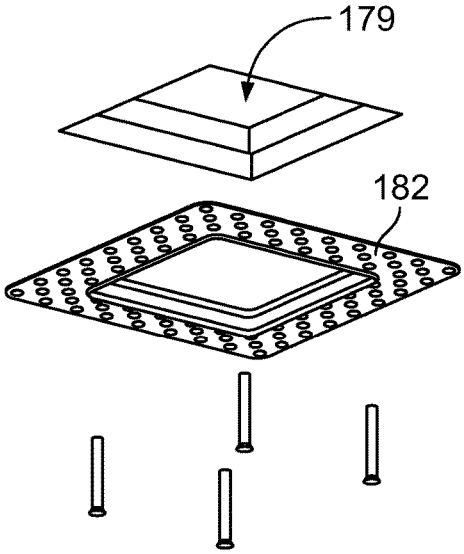
Figure 43:
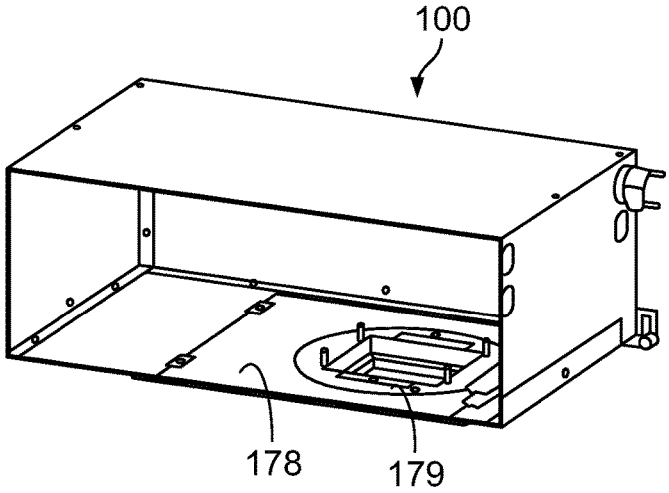
Figure 44:
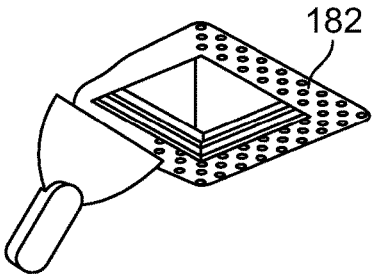
Figure 45:
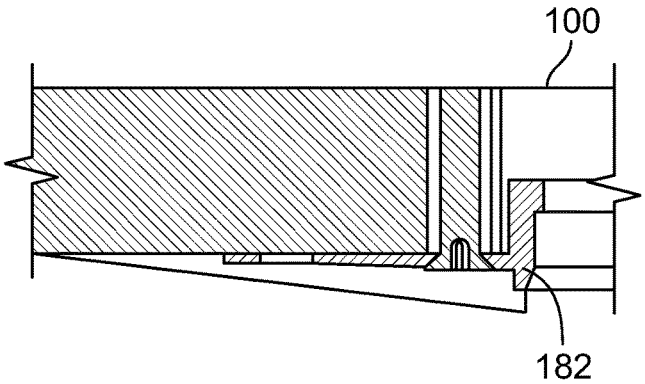

FIGS. 35-37 depict the cylindrical luminaire 10 being installed within the opening 116 of the housing 100 by rotating the wings 24 from a downward resting position to an upward position and inserting the luminaire 10 into the opening 116 within the housing 100.

FIGS. 38 through 45 illustrate adapter plates 176, 178 that each include an opening 177, 179, respectively, mounted to the housing 100 within a ceiling. A rough-in flange 180, 182, respectively, is then assembled to the housing 100. Once assembled, the flange 180, 182 is skim coated (see FIGS. 40, 41, 44, 45) to cover the flange 180, 182 and blend the surface which the flange 180, 182 extends over with the rest of the surface of the ceiling.

FIGS. 46-58 illustrate an adjustable luminaire assembly 300 and features thereof according to an exemplary embodiment of the present disclosure.

Figure 46:
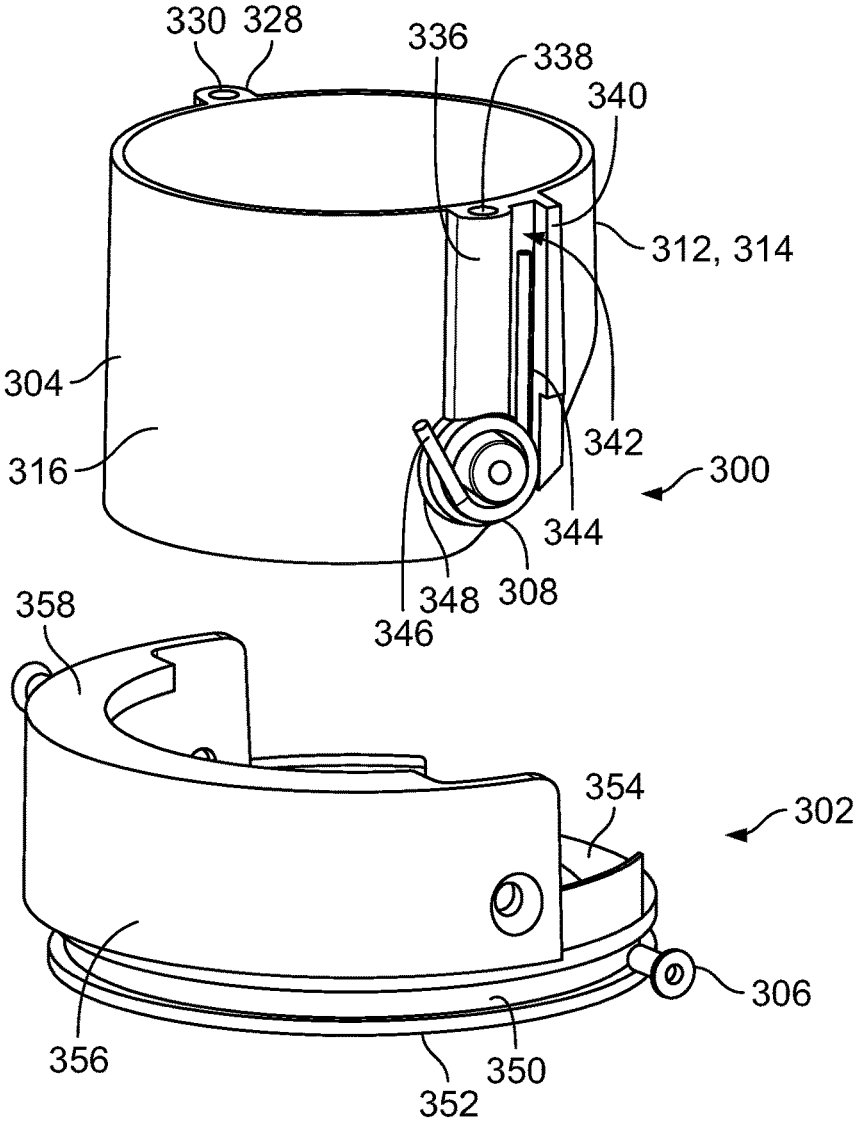
FIG. 46 is an exploded view of a rotatable housing assembly for a luminaire, such as the luminaire depicted in FIG. 1, according to an embodiment of the present disclosure.
Figure 47:
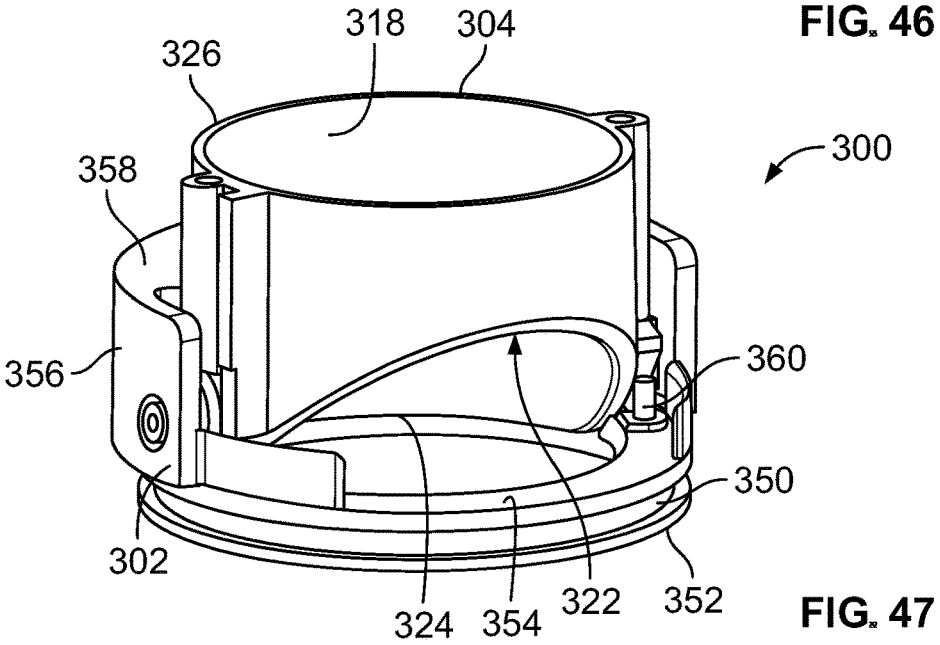
FIGS. 47-50 are various perspective views of the rotatable housing assembly of FIG. 16 in a vertical orientation.
Figure 48:
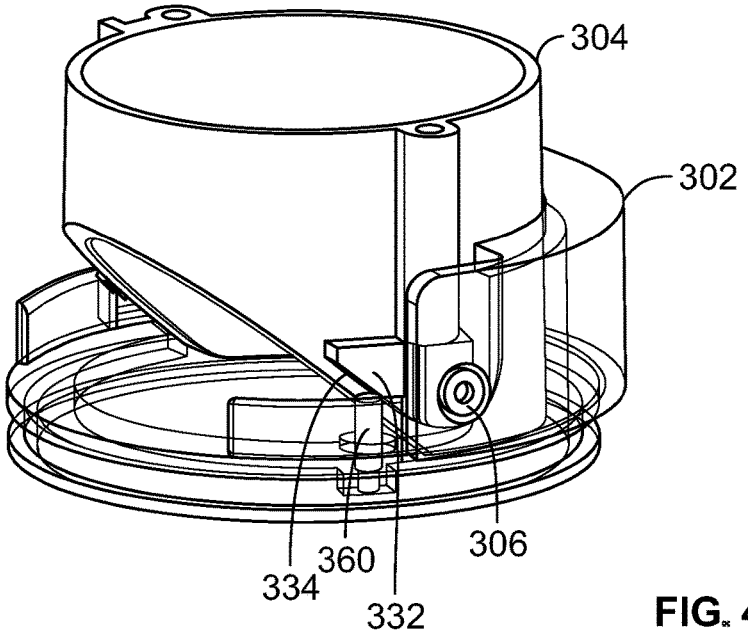
Figure 49:
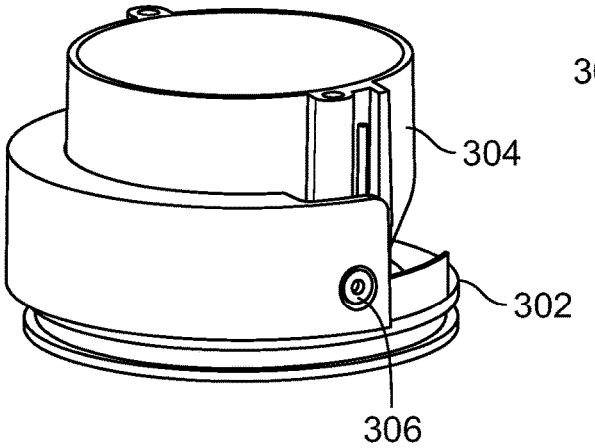
Figure 50:
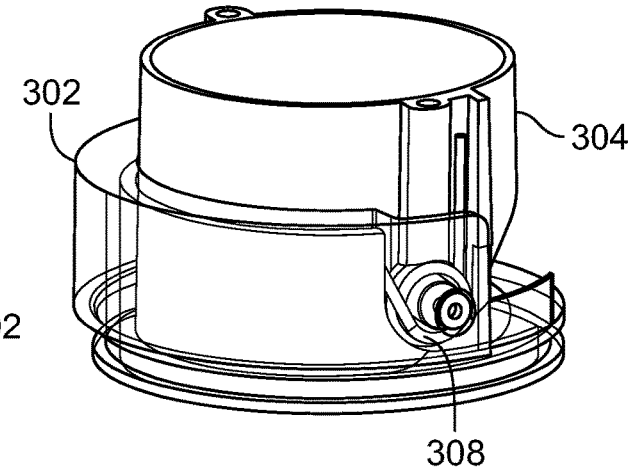
Figure 51:
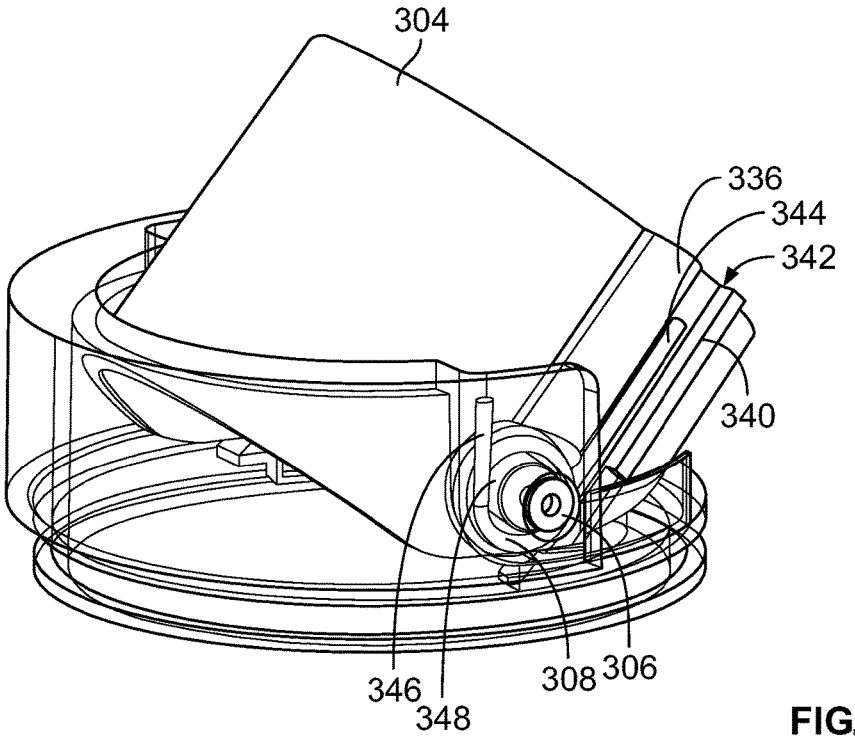
FIGS. 51-52 are various perspective views of the rotatable housing assembly of FIG. 16 in a rotated or tilted orientation.
Figure 52:
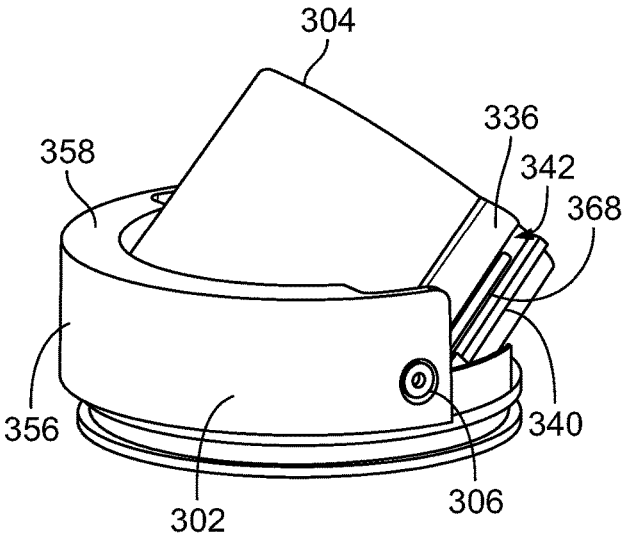
Figure 53:
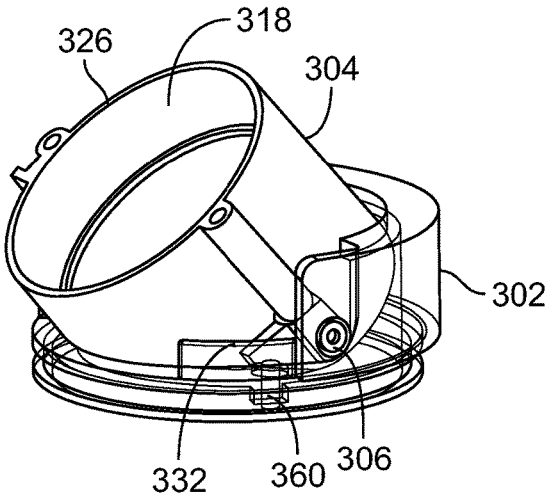
FIGS. 53-56 are various views of a sliding covering of the rotatable housing assembly that extends about an outer periphery of a luminaire housing.
Figure 54:
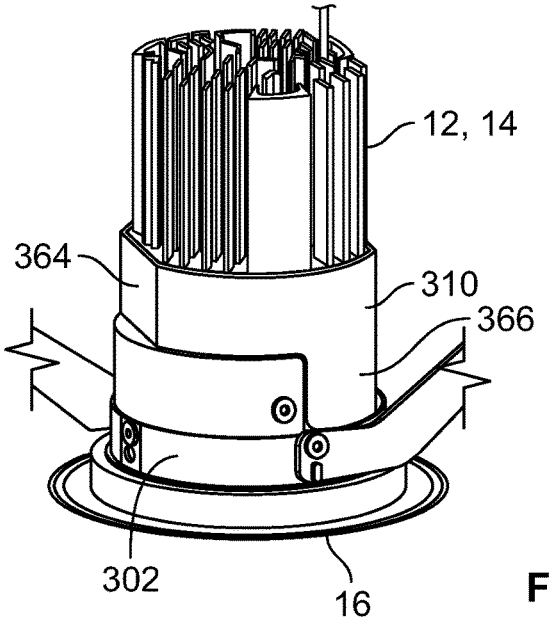
Figure 55:
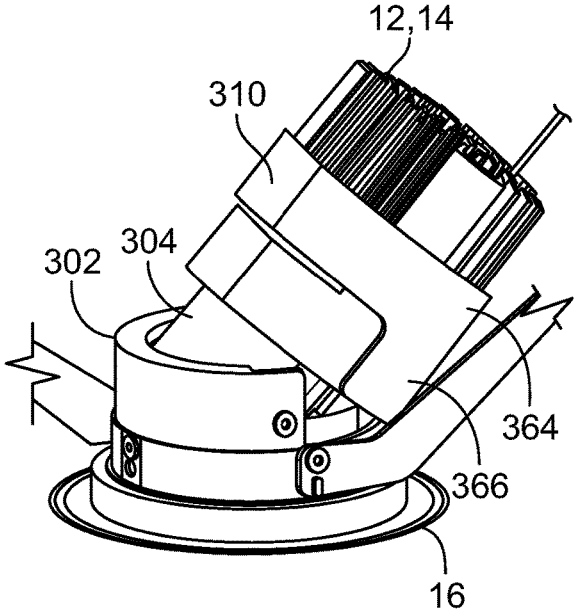
Figure 56:
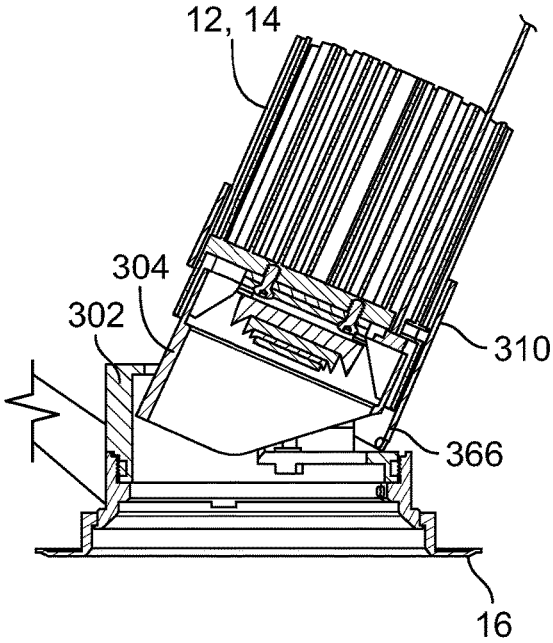

As can be seen in FIG. 46, the adjustable housing assembly 300 for a luminaire generally includes a base 302, a casing 304 that is rotatably coupled to the base 302 by one or more fasteners 306, a spring 308 that aids to tilt the assembly 300 and a luminaire housed therein with respect to an opening in a surface, and a sleeve 310 that is configured to extend over an outer periphery of a luminaire housing.

The casing 304 includes a hollow cylindrical body 312 that is defined by a sidewall 314 that has a first surface 316 and a second surface 318. The sidewall 314, which defines a cavity 320 therein, includes a sloped region 322 that extends from a first open end 324 toward a second open end 326 of the cylindrical body 312. The sloped region 322 of the sidewall 314 provides clearance to allow the casing 304, when desired, to rotate or tilt relative to the base 302.

A first spine 328 projects from the first surface 316 of the sidewall 314 of the cylindrical body 312 with a first opening 330, that can include threading, extending therein. An arm 332 extends substantially perpendicular to and beneath the first spline 328 (see FIG. 48). The arm 332 includes an angled bottom 334 surface. A second spine 336 projects from the first surface 316 of the sidewall 314 of the cylindrical body 312 approximately 180° from the first spine 328 and includes a second opening 338, which can be threaded, that extends therein. Additionally, a flange 340 extends from the first surface 316 of the of the sidewall 314 of the cylindrical body 312. The flange 340 is spaced from the second spine 336 to form a groove 342 therebetween.

The spring 308, such as, a torsional spring, that includes a first arm 344 that extends in a first direction and a second arm 346 that extends in a second direction, is arranged over or coiled about a protrusion 348 that extends from the first surface 316 of the sidewall 314 of the cylindrical body 312, beneath the second spline 336 with the first arm 344 extending within the groove 342.

The base 302 includes a cylindrical rim 350 that is delimited by a first flange 352 and a second flange 354 that is spaced from the first flange 352. A sidewall 356 extends substantially perpendicular from the rim 350. The sidewall 356 extends partially about (i.e., at least 50%) the circumference of the rim 350 such that the sidewall 356 does not extend entirely about the rim 350. A lip 358 extends from a distal end of the sidewall 356 inwardly toward the center of the rim 350. Additionally, a projection 360 extends from the rim 350 in an upward direction. The projection 360 can, for example, be a set screw.

In an assembled state, the torsional spring 308 is configured to orientate the casing 304 at an angle while the projection 360 that extends from the base 302 is configured to limit the orientation angle of the casing 304 and return the casing 304 to a vertical, upright position.

FIGS. 54-58, illustrate the sleeve or collar 310 that is slidably coupled to the luminaire housing 12 and the associated heatsink 14 of a luminaire assembly 10. The sleeve 310 is configured to automatically adjust to any tilt angle of the assembly 300 to block a line-of-sight into a ceiling cavity or housing, regardless of the tilt angle or lack thereof. In other words, the sleeve 310 acts as a shade to ensure any gap that may exist between the luminaire 10 and housing is covered to avoid such a gap from being seen.

The sleeve 310 has a hollow body 364 that includes a protrusion 366 extending downwardly from the body 364. The hollow body 364 encircles the luminaire 10 and the heatsink 14 and enables the collar 362 to be slid upwardly and downwardly along the length of the housing 12 and associated heatsink 14 while at the same time interacting with the base 302 and casing of the assembly 300. The collar 362 includes a projection 365 that is configured to mate with a groove 11 of the luminaire housing 12 to prevent the collar 362 from sliding off of the luminaire 10.

Figure 57:
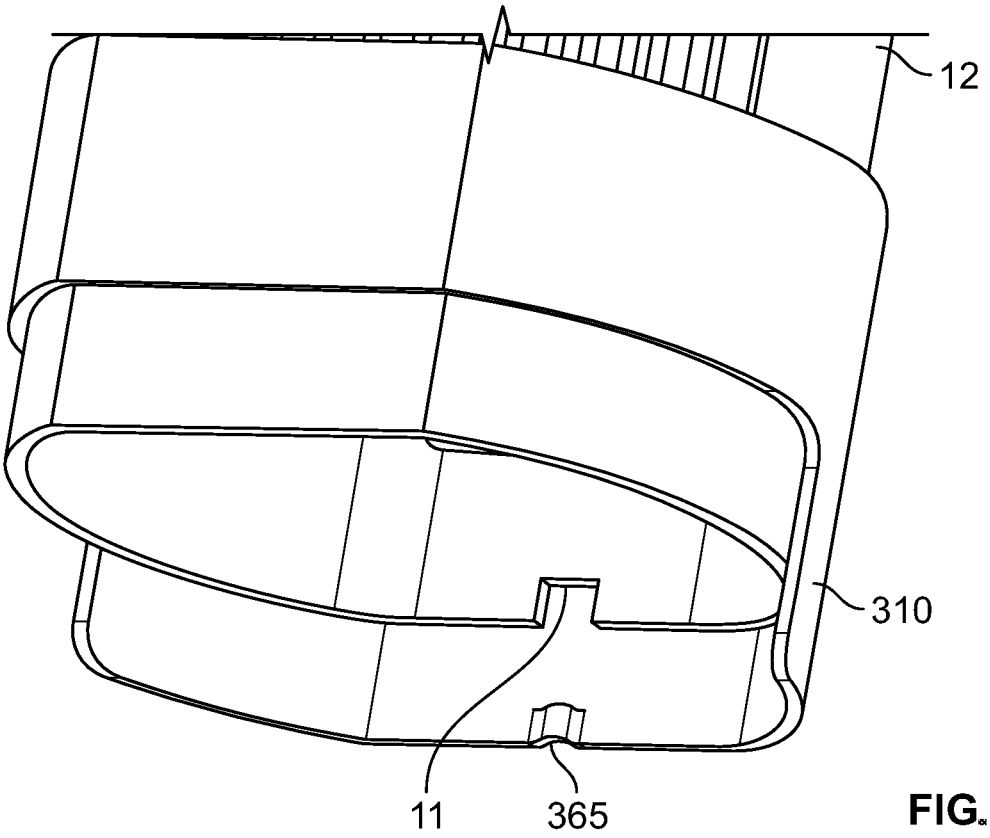
FIGS. 57 and 58 are a partial perspective view of the sliding covering of FIGS. 53-56 at different positions about the outer periphery of the luminaire housing.
Figure 58:
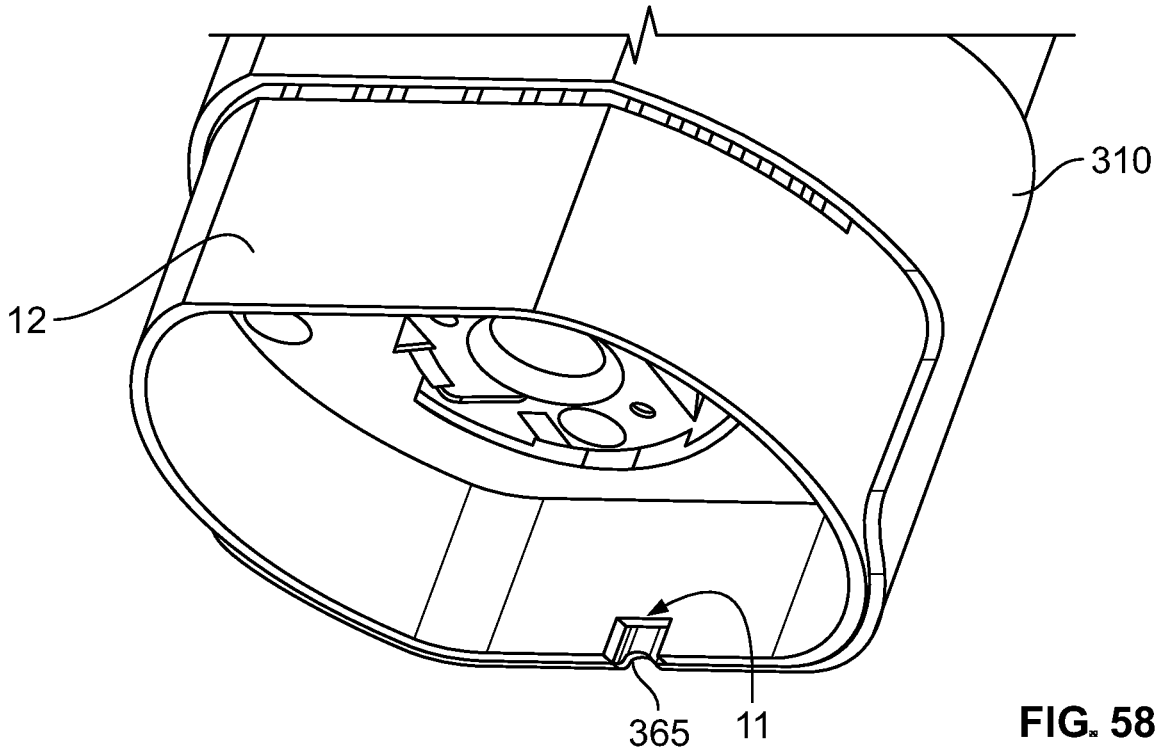

As illustrated in FIGS. 57 and 58, the body 36 with the sidewall of the sleeve 310 forms a step-like structure that complements the step-like structure of the housing 12 of the luminaire.

This step-like structure of the sleeve 310 slides along the luminaire 10 as the assembly 300 tilts to block light leakage from the opening formed by the sloped region 322 of the casing 304, and blocks the line of sight to the ceiling or housing upon rotation.

While the assembly 300 described above are circular, the present invention is not limited to this configuration. Rather, the assembly can take the form of other shapes, for example, a square.

Although the description above and accompanying drawings contains much specificity, the details provided should not be construed as limiting the scope of the embodiments, but merely as describing some of the features of the embodiments. The description and figures should not to be taken as restrictive and are understood as broad and general teachings in accordance with the present invention. While the embodiments have been described using specific terms, such description is for illustrative purposes only, and it is to be understood that modifications and variations to such embodiments, including, but not limited to, the substitutions of equivalent features and terminology may be readily apparent to those of skill in the art based upon this disclosure without departing from the spirit and scope of the invention.

What is claimed is:

1. A light system assembly, comprising:

a light engine having a lens;

a light trim having a reflector; and at least one fastener assembly that is fastened to the light trim and extends through an opening in the light engine such the at least one fastener secures the light trim to the light engine, wherein the at least one fastener assembly includes a shaft that is surrounded by a spring such that, when desired, an individual can apply a force to the light engine upwardly, which in turn causes the spring to compress such that the light trim moves in a downward direction relative to the light engine and away from the light engine, allowing the individual to grasp the light trim and pull the light system assembly in a downward direction.

2. The light system of claim 1, wherein the at least one fastener assembly includes a first fastener that has a shaft extending between a first end and a second end thereof with a head fixed to the first end of the shaft, a sleeve extending substantially over the shaft, a spring encircling the sleeve and a second fastener configured to interact with the shaft to secure the at least one fastener assembly to the light engine.

3. The light system of claim 2, wherein the second fastener has a through hole, extends over the shaft, and is fixed to the shaft adjacent to an end of the sleeve such that the sleeve is held captive about the shaft when the second fastening assembly is fixed about the shaft of the light engine.

4. The light system of claim 2, further comprising a washer configured to extend over the shaft and be arranged between the sleeve and the second fastener.

5. The light system of claim 2, wherein the light trim includes a hole defined by a sidewall and a base such that the hole is delimited at one end thereof.

6. The light system of claim 5, wherein the shaft is configured to extend into the hole of the light trim and be fixed within the hole.

7. The light system of claim 2, wherein the second fastener delimits compression of the spring and in turn movement of the light engine and the light trim.

8. The light system of claim 1, wherein the spring is compressible.

9. The light system of claim 1, wherein the light trim includes a recess and the light engine includes a sidewall that is configured to extend within the recess of the light trim.

10. The light system of claim 9, wherein, upon a force applied to the light trim, the spring is compressed and the light trim moves toward away the light engine to create space between the second housing and the first housing to allow an accessory to be fixed between the light engine and the light trim.

* * * * *